US011260391B2

(12) United States Patent
Banerjee et al.

(10) Patent No.: US 11,260,391 B2
(45) Date of Patent: Mar. 1, 2022

(54) ENHANCED CAPTURE OF MAGNETIC MICROBEADS IN MICROFLUIDIC DEVICES USING SEQUENTIALLY SWITCHED ELECTROOSMOTIC FLOW

(71) Applicants: Rupak K. Banerjee, Mason, OH (US); Debarun Das, Mason, OH (US); Marwan Al-Rjoub, Mason, OH (US)

(72) Inventors: Rupak K. Banerjee, Mason, OH (US); Debarun Das, Mason, OH (US); Marwan Al-Rjoub, Mason, OH (US)

( * ) Notice: Subject to any disclaimer, the term of this patent is extended or adjusted under 35 U.S.C. 154(b) by 370 days.

(21) Appl. No.: 16/548,542

(22) Filed: Aug. 22, 2019

(65) Prior Publication Data

US 2020/0055047 A1 Feb. 20, 2020

Related U.S. Application Data

(63) Continuation-in-part of application No. 15/005,223, filed on Jan. 25, 2016, now abandoned.

(51) Int. Cl.
*B01L 3/00* (2006.01)

(52) U.S. Cl.
CPC ..... *B01L 3/502715* (2013.01); *B01L 3/50273* (2013.01); *B01L 3/502753* (2013.01); *B01L 2200/0668* (2013.01); *B01L 2300/06* (2013.01); *B01L 2400/043* (2013.01)

(58) Field of Classification Search
CPC ..... B01L 3/502715; B01L 3/50273; B01L 3/502753; B01L 3/502761; B01L 2200/0668; B01L 2300/06; B01L 2300/0645; B01L 2400/043; B01L 2400/0418
See application file for complete search history.

(56) References Cited

FOREIGN PATENT DOCUMENTS

JP 2006513031 A * 4/2006

OTHER PUBLICATIONS

Cao, Z. et al. "Microchannel plate electro-osmotic pump." Microfluid Nanofluid (2012) 13 279-288. (Year: 2012).*

* cited by examiner

*Primary Examiner* — Christopher Adam Hixson

(57) ABSTRACT

Methods of increasing the capture efficiency of a microfluidic device for a target reagent, without additional complications to the design of existing microfluidic devices, and more particularly methods of increasing the capture efficiency of a microfluidic device for magnetic microbeads within a microfluidic channel using sequentially switched electroosmotic flows.

22 Claims, 18 Drawing Sheets

ENHANCED CAPTURE OF MAGNETIC MICROBEADS IN MICROFLUIDIC DEVICES USING SEQUENTIALLY SWITCHED ELECTROOSMOTIC FLOW

CROSS-REFERENCE TO RELATED APPLICATION

This application is a Continuation in Part of U.S. application Ser. No. 15/005,223 which in turn depends from and claims priority to U.S. Provisional Application No. 62/106,883 filed Jan. 23, 2015, the entire contents of which are incorporated herein by reference.

FIELD

The present disclosure relates to methods of increasing the capture efficiency of microfluidic devices for a target reagent. More specifically, the present disclosure relates to methods of increasing the capture efficiency of microfluidic devices for magnetic microbeads within a microfluidic channel by using sequentially switched electroosmotic flow.

BACKGROUND

Research in the field of microfluidics has led to the development of tools that enable biochemical assays to be conducted on portable devices with faster response times compared to experiments on a laboratory scale. Microfluidic devices have potential applications in the development of diagnostic devices, such as for immunoassays that help detect biomolecules, cells, and pathogens in throughput screening, and are attractive due to advantages of miniaturization, automation, and integration.

Magnetic microbeads have been utilized with microfluidic devices. Some devices have employed either a permanent magnet or an electromagnet to capture and transport the magnetic microbeads within a microfluidic device. Magnetic microbeads are often entrained within fluid flowing through a channel in the microfluidic device, and are used to capture a component of interest on the beads from the surrounding fluid. Once the component of interest is captured on the bead, the beads are captured using a magnetic field. The captured beads can be moved to a region of the microfluidic device where the component of interest can be detected or where the component of interest can be released from the beads to undergo further processing.

The magnetic microbeads can be carried in a pressure or electrokinetically driven fluid. Electrokinetically driven flows, such as electroosmotic flow, have advantages in microfluidics as electroosmotic flow does not require mechanical pumps to drive the flow. Electroosmotic flow is driven by an external electric field. The electric field in a microchannel of the microfluidic device is achieved by placing electrodes in the inlet and outlet of the microchannel, e.g. the inlet and outlet reservoirs of the microchannel, and applying a voltage potential across them. The flow rate is in direct proportion to the applied electric field. The component of interest that is captured by the magnetic microbeads experiences minimal disturbance during the manipulation process by an external magnetic field. Additionally, the manipulation of a component of interest using magnetic microbeads is effective because the magnetic interactions are not generally affected by surface charges, pH, ionic concentrations, or temperature. Magnetic labeling is more robust than other labeling methods, such as fluorescent labeling, because the magnetic property of a particle cannot be quenched at normal working temperatures.

However, reduced capture efficiency of microfluidic devices for magnetic microbeads affects the sensitivity of the microfluidic devices to capture and/or detect target reagents from dilute samples. Additionally, imperfect magnetic microbead retention leads to the loss of samples and expensive reagents. While several studies have attempted to develop novel techniques for capturing magnetic microbeads using different channel and/or magnetic field configurations, very few studies have focused on the techniques to improve the capture efficiency of microfluidic devices for magnetic microbeads without additional complications in the flow path and/or magnetic field configurations. Some devices and models rely on elaborate magnetic fields to improve the capture efficiency, adding additional complications to the designs of these devices. Other devices and models rely on very low flow rates for successful magnetic microbead separation. However, such low flow rates are not conducive for high throughput microfluidic devices.

There is, therefore, a need in the art for novel methods that improve the increasing the capture efficiency of microfluidic devices for magnetic microbeads and other target reagents without additional complications to the design of existing microfluidic devices.

SUMMARY

It is understood that both the following summary and the detailed description are exemplary and explanatory and are intended to provide further explanation of the disclosure as claimed. Neither the summary nor the description that follows is intended to define or limit the scope of the disclosure to the particular features mentioned in the summary or description.

One object of the present disclosure is to provide methods of increasing the capture efficiency of microfluidic devices for a target reagent, without additional complications to the design of existing microfluidic devices. This object is achieved by the present disclosure that provides methods of increasing the capture efficiency of microfluidic devices for a target reagent within a microfluidic channel using sequentially switched electroosmotic flows.

In some aspects, a method of increasing the capture efficiency of a microfluidic device is provided. The method comprises: a) providing a microfluidic device comprising at least one microfluidic channel, the at least one microfluidic channel comprising a first end and a second end b) generating a first electroosmotic force sufficient to cause the target reagent to flow in a first flow direction within the at least one microfluidic channel; c) generating a second electroosmotic force sufficient to cause the target reagent to flow in a second flow direction within the at least one microfluidic channel, wherein the second flow direction is the reverse of the first flow direction; and d) applying a magnetic field to the at least one microfluidic channel, thereby generating a magnetic force for capturing the target reagent in the at least one microfluidic channel with the magnetic field.

In other aspects, increasing the efficiency of a microfluidic device is provided. The method comprises: a) providing a microfluidic device comprising at least one microfluidic channel, the at least one microfluidic channel comprising a first end and a second end; b) generating an electroosmotic flow sufficient to cause the target reagent to flow in a first flow direction within the at least one microfluidic channel; c) reversing the electroosmotic flow, wherein the reversal of the electroosmotic flow is sufficient to reverse the flow direction of the target reagent within the at least one microfluidic channel; and d) applying a magnetic field to the at least one microfluidic channel, thereby generating a magnetic force for capturing the target reagent in the at least one microfluidic channel with the magnetic field.

In another aspect, increasing the efficiency of a microfluidic device is provided. The method comprises: a) providing a microfluidic device comprising at least one microfluidic channel, the at least one microfluidic channel comprising a first end and a second end; b) generating an electroosmotic flow sufficient to cause the target reagent to flow in a first flow direction within the at least one microfluidic channel; c) reversing the electroosmotic flow, wherein the reversal of the electroosmotic flow is sufficient to reverse the flow direction of the target reagent within the at least one microfluidic channel; d) applying a magnetic field to the at least one microfluidic channel by way of initializing an electric current in a direction in an electromagnet, thereby generating a magnetic force for capturing the target reagent in the at least one microfluidic channel with the magnetic field and e) applying a magnetic field to the at least one microfluidic channel by way of initializing an electric current in an opposite direction in an electromagnet, thereby generating a transient variance in magnetic force for capturing the target reagent in the at least one microfluidic channel with the magnetic field. Improved capture of beads is thus achieved by dynamically changing the voltage/electric field applied to the electro-magnet allowing transient variation of the magnetic field. Both amplitude and frequency of the voltage/electric-field can be altered for optimizing the capture efficiency. In this aspect of the invention, device orientation in relation to the placement magnet/electromagnet and fluorescent/optical detectors are unique. This unique arrangement in combination of oscillatory-electroosmotic flow (EOF) allows improved capture of magnetic beads at the top-surface of the microchannel while detection is achieved from the bottom.

DETAILED DESCRIPTION

Figure 1:
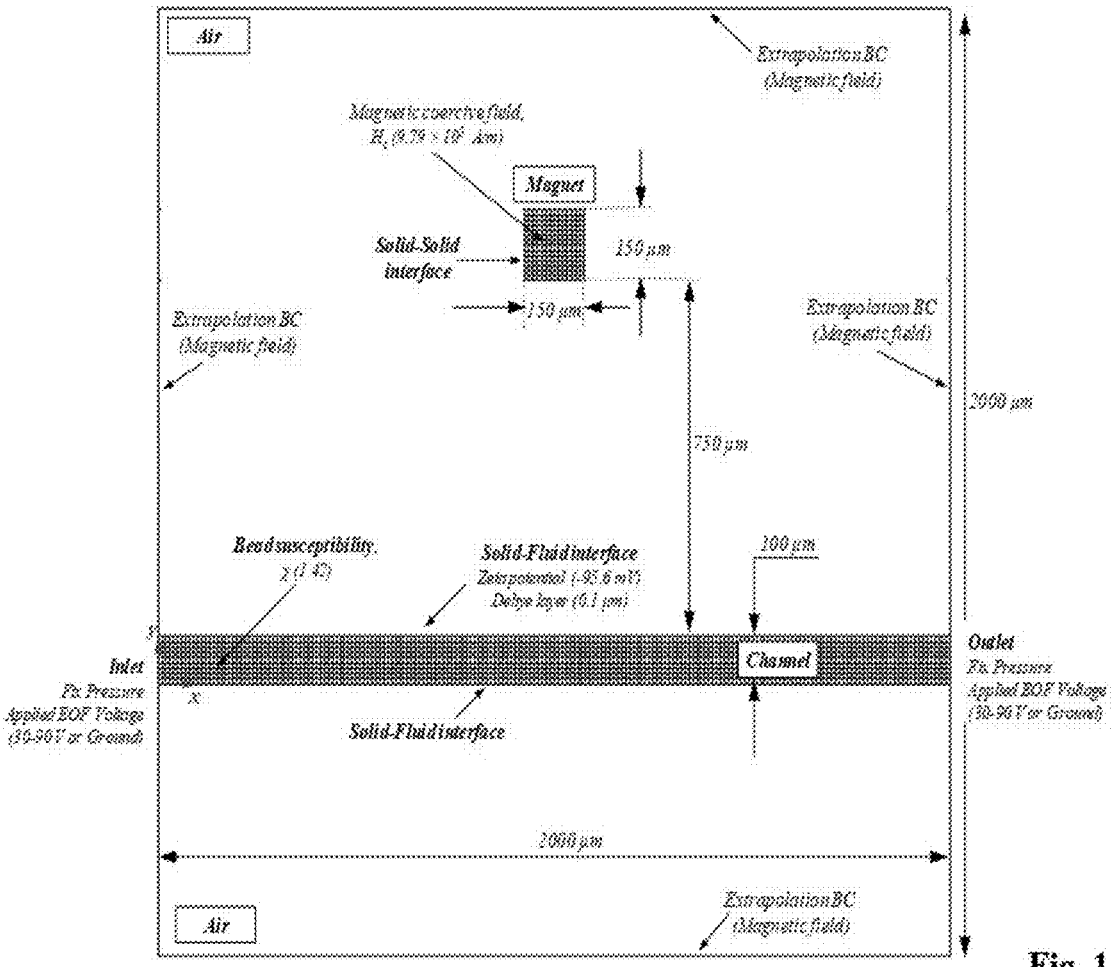
FIG. 1. The computational domain, comprising a miniaturized magnet and a microchannel, generated using the CFD-GEOM package (CFD-GEOM, Huntsville, Ala., USA)

The following description of particular aspect(s) is merely exemplary in nature and is in no way intended to limit the scope of the invention, its application, or uses, which may, of course, vary. The invention is described with relation to the non-limiting definitions and terminology included herein. These definitions and terminology are not designed to function as a limitation on the scope or practice of the invention but are presented for illustrative and descriptive purposes only. While the processes are described as using specific materials or an order of individual steps, it is appreciated that materials or steps may be interchangeable such that the description of the invention may include multiple parts or steps arranged in many ways as is readily appreciated by one of skill in the art.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

Throughout the specification and claims, the following terms take the meanings explicitly associated herein, unless the context clearly dictates otherwise. The phrase "in one embodiment" or "in one aspect" as used herein does not necessarily refer to the same embodiment or aspect, though it may. Furthermore, the phrase "in another embodiment" or "in another aspect" as used herein does not necessarily refer to a different embodiment or aspect, although it may. Thus, as described below, various embodiments or aspects of the invention may be readily combined, without departing from the scope or spirit of the instant disclosure.

Unless otherwise defined, all terms (including technical and scientific terms) used herein have the same meaning as commonly understood by one of ordinary skill in the art to which this disclosure belongs. It will be further understood that terms such as those defined in commonly used dictionaries, should be interpreted as having a meaning that is consistent with their meaning in the context of the relevant art and the present disclosure, and will not be interpreted in an idealized or overly formal sense unless expressly so defined herein.

The present disclosure provides methods for increasing the capture efficiency of microfluidic devices for a target reagent, without additional complications to the design of existing microfluidic devices. The provided methods result in increased capture efficiency of q microfluidic device for magnetic microbeads within a microfluidic channel by utilizing sequentially switched electroosmotic flows. The instant methods can be used in any microfluidic device that includes at least one microfluidic channel, including commercially available microfluidic device.

As such, in once aspect a method for increasing the capture efficiency of a microfluidic device for a target reagent includes a) providing a microfluidic device comprising at least one microfluidic channel, b) generating a first electroosmotic force sufficient to cause the target reagent to flow in a first flow direction within the at least one microfluidic channel; c) generating a second electroosmotic force sufficient to cause the target reagent to flow in a second flow direction within the at least one microfluidic channel, wherein the second direction is the reverse of the first direction; and d) applying a magnetic field to the at least one microfluidic channel, thereby generating a magnetic force for capturing the target reagent in the at least one microfluidic channel with the magnetic field.

It was unexpectedly found that changing the electroosmotic flow direction in a microfluidic microchannel using periodic switching of electroosmotic force can significantly improve the capture efficiency of microfluidic devices for magnetic microbeads (and target reagents of interest captured on the magnetic microbeads). Such switching of the applied electric field also enabled better control over flow rate and its direction. Additionally, the plug profile of electroosmotic flow ensured uniform distribution of magnetic microbeads in the flow through the microchannel. The rationale behind switching of the electroosmotic flow, was to increase the residence time of the magnetic microbeads in the region of higher magnetic fields. This was achieved by changing the direction of applied electric field, causing escaped magnetic microbeads (microbeads that initially escaped the applied magnetic field), to return to the capture zone of the magnetic field. Numerical results and experimental data demonstrate that electroosmotic flow reversal significantly improved the capture efficiency, as discussed in further details below.

A numerical model demonstrated a simple technique of sequential switching which can be used in electroosmotic flow systems for efficient capture of a microfluidic device for magnetic microbeads using a miniaturized magnet. The unidirectional flow of magnetic microbeads from the inlet to the outlet of microfluidic channel in a steady electric field showed a linear decrease in the capture efficiency of the microfluidic device for the magnetic microbeads with an increase in the applied electric field. The sequential switching of this electroosmotic flow electric field caused the direction of the electroosmotic flow field to reverse periodically, and led to an increase in capture efficiency of the microfluidic device for the magnetic microbeads due to the capture of the magnetic microbeads that initially escaped the magnetic field. The sequential switching of electroosmotic flow improved the capture efficiencies at both high (400-450 V/cm) and low (150-200 V/cm) electric field ranges evaluated by the model. The capture efficiency also improved significantly with increase in switching distances. The increase in capture efficiency was due to decreased velocity of flow field and increased residence time of magnetic microbeads s in the capture zone. The improvements in capture efficiency were more significant at higher electric field (400-450 V/cm) where relative increase in capture efficiency due to prolonged period of switching was 15.8% compared to 4.9% at lower electric field (150-200 V/cm). The method of switching efficiently captured the magnetic microbeads and overcame the reduced magnetic field strength in the channel due to the smaller size of the magnet.

Experimental data demonstrated that for the steady electroosmotic flow (unidirectional flow of magnetic microbeads from inlet to outlet), the capture efficiency of the microfluidic device for magnetic microbeads decreased with increase in electroosmotic flow voltage. However, the sequential switching of electroosmotic flow voltage caused the direction of flow to change periodically. This reversal in flow, field caused the previously uncaptured magnetic microbeads to return to the capture zone and improved the capture efficiency of the microfluidic device. Similar to the numerical model data, the sequential switching of electroosmotic flow improved the capture efficiencies of the microfluidic device at both high (750, 900 V) and low (500, 600 V) EOF voltage ranges. These improvements were more significant at higher voltages of 750 V and 900 V where capture efficiency with switching was, on an average, ~70% more compared to flow without switching. Thus, the instant disclosure demonstrates that the technique of sequential switching of electroosmotic flow has the potential to reduce the loss of reagents in high throughput microfluidic devices. The reduced size of the magnet and magnetic microbead capture with electroosmotic flow switching can enable the fabrication of efficient and portable microfluidic devices for field testing.

Methods in accordance with the invention can be practiced on a wide variety of microfluidic devices, including commercially available microfluidic devices. The defining characteristics of a microfluidic device that is compatible with the practice of the methods of the instant disclosure is that the microfluidic device contains at least one microchannel. A microchannel defines a passageway for a fluid sample (e.g., gas or liquid) to flow through while the target reagent within the fluid sample can be capture/collected by an applied magnetic field. "Fluid sample" refers to any flowable material that comprises the magnetic microbeads and/or one or more other target reagents of interest. Without wishing to be bound by theory, the fluid samples can be liquid (e.g., aqueous or non-aqueous), supercritical fluid, gases, solutions, and suspensions. When a reagent in a sample (e.g., target reagent of interest) is ferromagnetic or otherwise has a magnetic property, such reagent can be captured using the instant methods without the use of magnetic microbeads.

A microchannel can include a first end and a second end, such as an inlet end and an outlet end. In other aspects, a microchannel can include a closed end. A compatible microchannel can be fluidly connected to an inlet and/or outlet reservoir, and/or be attached to well structure. Wells on microfluidic devices can be configured in a number of different ways. Details of such inlet and outlet reservoirs and/or well structures, such as its cross-sectional shape, whether they formed entirely within one substrate, in multiple substrates, or in a substrate and a cover layer, are largely irrelevant to the practice of the instant methods, as long as the inlet and outlet reservoirs and/or well structures interface with a microfluidic microchannel(s).

Microfluidic devices compatible with the instant methods can comprise multiple microchannels or a microfluidic channel network, such as multiplexed microfluidic devices. As is known in the art, configuring two or more microchannels on a single microfluidic device can increase sample-processing throughput and/or allow for parallel processing of at least two samples or portions of the sample for different fractions or manipulations. For example, two or more microchannels can be arranged in series, in parallel, or in a combination thereof.

The length of a microchannel(s) compatible with the instant methods can be of any dimension. The longer the microchannel(s), the longer the residence time a fluid sample (with the target reagent) can experience a magnetic field gradient before leaving the microchannel(s) of a microfluidic device. For example, microchannel(s) can have a length of including, but not limited to, about 0.5 mm to about 50000 mm, or any value or range in between. Likewise, the width and depth of the microchannel(s) compatible with the instant methods can be of any dimension. The microchannels can have the same width and depth, or the two or more microchannels can have different widths and depths. In certain aspects, the microchannel(s) can have a width and/or depth that is greater than the average size of the target reagent of interest in a sample delivered to the microchannel(s). In another embodiment the microchannel(s) can has a width equal to or greater than the largest target reagent (such as the largest cell) that is separated from the sample delivered to the microchannel(s). For example, a microchannel in a microstructure can have a width and/or depth including, but not limited to, from about 5μιη to about 1000μιη. Furthermore, a microchannel(s) can have side walls that are parallel to each other, and/or a top and bottom that are parallel to each other. A microchannel compatible with the instant methods can also have regions with different cross sections. Suitable microchannel(s) can have a cross-section of any shape, e.g., a circle, an ellipse, a triangle, a square, a rectangle, a polygon or any irregular shape.

Microfluidic devices compatible with the instant methods can include a body or a substrate, as are known in the art, with the microchannel(s) disposed therein. For example, the microchannel(s) can be formed, including but not limited to, entirely within one substrate, in multiple substrates, or in a substrate and a cover layer.

The material from which the microfluidic device is made is largely irrelevant to the practice of the instant methods, as long as the material does not contaminate or otherwise interfere with the reagents, samples, or reactions involved in practicing the instant methods. Exemplary materials that can be used for a microfluidic device that is compatible with the instantly disclosed methods include, but are not limited to, glass, quartz, silicon, polymethylsiloxane (PDMS), PDMS-glass, PDMA silica, and polymeric materials such as polymethylmethacrylate (PMMA), polycarbonate, polytetrafluoroethylene (TEFLON™), polyvinylchloride (PVC), polydimethylsiloxane (PDMS), polysulfone, polystyrene, polymethylpentene, polypropylene, polyethylene, polyvinylidine fluoride, ABS (acrylonitrile-butadiene-styrene copolymer), cyclic-olefin polymer (COP), and cyclic-olefin copolymer (COC).

The methods described herein can be used for separating at least one magnetically-labeled target reagent from a fluid sample. Thus, to perform the instant methods, a plurality of magnetic beads (which can include capture moieties on the surface thereof) in a sample fluid containing a target reagent can be placed within a microchannel. In certain aspects, the plurality of sample fluid containing a target reagent and magnetic beads are placed within an inlet reservoir or well that is in fluid communication with a microchannel. When a reagent in a sample (e.g., target reagent of interest) is ferromagnetic or otherwise has a magnetic property, such reagent can be captured using the instant methods without the use of magnetic microbeads.

Any magnetic bead that responds to or can be manipulated by a magnetic field and/or magnetic field gradient may be employed in the methods of the instant disclosure. As used herein, the term "magnetic bead" can refer to a nano- or micro-scale particle that is attracted or repelled by a magnetic field gradient or has a non-zero magnetic susceptibility. Magnetic beads (including nanoparticles or microparticles) are well-known, commercially available, and methods for their preparation have been described in the art. The magnetic beads can be ferromagnetic, paramagnetic or super-paramagnetic. Magnetic beads can be of any shape, including but not limited to spherical, rod, elliptical, cylindrical, and disc. In some embodiments, magnetic particles having a substantially spherical shape and defined surface chemistry can be used to minimize chemical agglutination and non-specific binding. Magnetic bead has a diameter including, but not limited to, between about 1 nm to about 1 mm, including any value or range inbetween.

Magnetic beads may include defined surface chemistry that can be used to minimize chemical agglutination and non-specific binding. Magnetic beads can also include capture or binding moieties, for capturing a target reagent. Binding or capture moieties can be bound to magnetic beads by any means known in the art, such as by chemical reaction, physical adsorption, entanglement, or electrostatic interaction. As is well known, the capture or binding moiety bound to a magnetic bead will depend on the nature of the target reagent of interest. Examples of capture or binding moieties include, without limitation, proteins (such as antibodies, avidin, and cell-surface receptors), charged or uncharged polymers (such as polypeptides, nucleic acids, and synthetic polymers), hydrophobic or hydrophilic polymers, small molecules (such as biotin, receptor ligands, and chelating agents), carbohydrates, and ions. Such capture moieties can be used to specifically bind target reagents of interest. Target reagents of interest can include, but are not limited to proteins, peptides, prions, toxins, infectious organisms (including but not limited to, bacteria, viruses, fungi), cells (including but not limited to, blood cells, white blood cells, NK cells, platelets, skin cells, cheek cells, sperm cells, trophoblasts, macrophages, granulocytes and mast cells), nucleic acids (such as DNA and RNA, including but not limited to, mRNA, rRNA, tRNA, siRNA, mitochodrial DNA, chromosomal DNA, genomic DNA, and plasmids), cell components, (including but not limited to, a nucleus, a chromosome, a ribosome, an endosome, a mitochondria, a vacuole, a chloroplast, and other cytoplasmic fragments), carbohydrates (including but not limited to, polysaccharides, cellulose or chitin) and lipids (including, but not limited to cholesterol, triglycerides).

In some aspects, the method of increasing the capture efficiency of a microfluidic device for a target reagent includes generating a first electroosmotic force sufficient to cause the target reagent to flow within the at least one microfluidic channel in a first flow direction. In some aspects, the method of increasing the capture efficiency of a microfluidic device for a target reagent includes generating an electroosmotic flow sufficient to cause the target reagent to flow in a first flow direction within the at least one microfluidic channel. In some aspects of the methods, the generating the first electroosmotic force or the electroosmotic flow comprises applying a first voltage differential between the first end and the second end of the at least one microfluidic channel sufficient to cause a reagent to flow within the at least one microfluidic channel in a first flow direction. In certain aspects of the methods, the step of applying the first voltage differential comprises applying a first voltage to the first end or inlet of the at least one microfluidic channel and a second voltage, lower than the first voltage, to the second end or outlet of the at least one microfluidic channel. In other aspects, the step of applying the first voltage differential comprises applying a first voltage to the first end or inlet of the at least one microfluidic channel and grounding the second end or outlet of the at least one microfluidic channel. The first voltage differential can include, but are not limited, both high (700-1000 V, including any value or range therebetween) and low (200-600 V, including any value or range therebetween) electroosmotic voltage differentials.

Selectively applying voltage to, by way of example and not limitation, the first end or inlet of the microfluidic channel, while applying a voltage of the opposite charge (or grounded) to, by way of example and not limitation, the second end or outlet of the microfluidic channel, creates a voltage differential between the first end or inlet of the microfluidic channel and the second end or outlet of the microfluidic channel. This differential will cause the magnetic microbeads and reagents in the fluid sample to flow through the microfluidic channel. This electroosmotic reagent flow occurs without the use of any pumps or valves. Thus, the microfluidic device may further include electrical connections, for example but not by way of limitation, at the first end or inlet of the microfluidic channel and the second end or outlet of the microfluidic channel which facilitate the application of the voltage required to move the reagents in the fluid sample through the microfluidic channel.

In some aspects, a method of increasing the capture efficiency of a microfluidic device for a target reagent includes generating a second electroosmotic force sufficient to cause the target reagent to flow within the at least one microfluidic channel in a second direction, wherein the second direction is the reverse of the first direction. In other aspects, the method comprises reversing the electroosmotic flow, wherein the reversal of the electroosmotic flow is sufficient to reverse the flow direction of the target reagent within the at least one microfluidic channel. Reversing the electroosmotic flow direction in a microfluidic microchannel using periodic switching of electroosmotic force can significantly improve the capture efficiency of a microfluidic device for a target reagent (e.g. target reagents of interest captured on the magnetic microbeads) in microfluidic systems by increasing the residence time of the magnetic microbead with a captured target reagent in the region of higher magnetic fields. The electroosmotic force can be reversed/switched by changing the direction of applied electric field, causing escaped magnetic microbeads (microbeads that initially escaped the applied magnetic field), to return to the capture zone of the magnetic field.

Thus, in some aspects of the methods, generating the second electroosmotic force comprises applying a second voltage differential between the first end or inlet and the second end or outlet of the at least one microfluidic channel sufficient to cause the reagent to flow within the at least one microfluidic channel in a second direction, wherein the second direction is the reverse of the first direction. In certain aspects, the step of generating the second electroosmotic force comprises reversing the first electroosmotic force. In other aspects of the methods, the step of applying the second voltage differential comprises applying a first voltage to the second end or outlet of the first channel and a second voltage lower than the first voltage, to the first end or inlet of the first channel. In even further aspects of the invention, the step of applying the second voltage differential comprises applying a first voltage to the second end or outlet of the at least one first channel and grounding the first end or inlet of the least one first channel. In certain aspects, the methods can further comprises removing the first voltage differential before applying the second voltage differential. The second voltage differential can include, but are not limited, both high (700-1000 V, including any value or range therebetween) and low (200-600 V, including any value or range therebetween) electroosmotic voltage differentials.

In some aspects of the methods, the first flow direction is towards the second end of the microfluidic channel. In other aspects, the first flow direction is towards an outlet of the microfluidic channel. In some aspects, the second flow direction is towards the first end of the microfluidic channel.

In some aspects, the method of increasing the capture efficiency of a microfluidic device for a target reagent comprises further switching of the electroosmotic flow direction in a microfluidic microchannel using additional steps of periodic switching of the electroosmotic force. The electroosmotic force, and thus electroosmotic flow, can be sequentially switched/reversed as many times as necessary to achieve the desired level of increased capture efficiency of a microfluidic device for a target reagent (e.g. magnetic microbeads with the attached/captured target reagents) by the applied magnetic field. In certain aspects of the methods, the electroosmotic flow is reversed at least twice. In other aspects, the methods include generating a third, fourth, fifth, etc electroosmotic forces sufficient to cause the reagent to flow within the at least one microfluidic channel in the first flow direction. By way of example, in certain aspects, generating the third electroosmotic force comprises applying a third voltage differential between the first end or inlet and the second end or outlet of the at least one microfluidic channel sufficient to cause the reagent to flow within the at least one microfluidic channel in the first direction. In certain aspects, the step of generating the third electroosmotic force comprises reversing the second electroosmotic force. In other aspects of the methods, the step of applying the third voltage differential comprises applying a first voltage to the first end or inlet of the at least one microfluidic channel and a second voltage, lower than the first voltage, to the second end or outlet of the at least one microfluidic channel. In other aspects, the step of applying the third voltage difference comprises applying a first voltage to the first end or inlet of the at least one microfluidic channel and grounding the second end or outlet of the at least one microfluidic channel. In certain aspects, the methods can further comprise removing the second voltage differential before applying the third voltage differential. The third voltage differential can include, but are not limited, both high (700-1000 V, including any value or range therebetween) and low (200-600 V, including any value or range therebetween) electroosmotic voltage differentials.

The timing and duration of the switching of the electroosmotic flow direction in a microfluidic microchannel using the instant methods of periodic switching of the electroosmotic force can vary. For example, the electroosmotic force can be switched when the magnetic beads (with the attached target reagents) move past the capture zone of the applied magnetic field. Thus, the second electroosmotic force, or in some situations the reversal of the first electroosmotic force, can be generated when the magnetic beads (e.g. with the attached target reagents) move past the capture zone of the applied magnetic field toward the second end or outlet of the microfluidic channel. Similarly, the third electroosmotic force, or in some situations the reversal of the second electroosmotic force, can be generated when the magnetic beads (with the attached target reagents) move past the capture zone of the applied magnetic field toward the first end or inlet of the microfluidic channel.

Control of the electroosmotic flow through the microfluidic channels of the microfluidic device can optionally be directed manually or can be directed by an instrument (not shown) that interfaces with the device. For example, but not by way of limitation, an electrical probe can be included at the first end or inlet of the microfluidic channel and at the second end or outlet of the microfluidic channel. A voltage controller that is capable of applying selectable voltage levels (including ground) can apply a voltage (i.e., a positive voltage) to the electrical probe the first end or inlet of the microfluidic channel while simultaneously applying the opposite voltage (i.e., a negative voltage or grounded) to the electrical probe at the second end or outlet of the microfluidic channel. The controller can be programmed to adjust the voltages at the various electrical probes to obtain the desired sequentially switched electroosmotic flows. The controller can be implemented in hardware, software, firmware or any combination thereof. The controller can be implemented in a computer (e.g., a personal computer), with software running on the computer for controlling the electrical probes.

In some aspects of the method of increasing the capture efficiency of a microfluidic device for a target reagent, a magnetic field is applied a magnetic field to the at least one microfluidic channel, thereby generating a magnetic force for capturing the target reagent in the at least one microfluidic channel with the magnetic field. For application of a magnetic field, a magnet can be placed in contact with or very close to the microfluidic channel. The magnet can be placed outside of the microfluidic device or can be integrated as part of the microfluidic device. The magnet can be removable or switchable, i.e., the magnetic field generated by the magnet that attracts and captures the magnetically-labeled target reagents can be turned off, or the direction and/or the magnitude of the magnetic field generated by the magnet can be modulated. The magnet can be mobile and can be moved in relation to the microstructure. The magnet will create a magnetic field such that a magnetic force captures the magnetic microbeads, and thus the captured target reagents. The magnetic force created by the magnet is of great enough magnitude such that the magnetic microbeads, and thus the captured target reagents will not continue to flow through the microfluidic channels of the microfluidic device.

The magnetic field can be generated by a permanent magnet. Permanent rare earth magnets, include, but not limited to, a neodymium magnet, which is a member of the rare earth magnet family and is generally referred to as an NdFeB magnet composed mainly of neodymium (Nd), iron (Fe) and boron (B). Additional examples of permanent magnet materials that can be used as a first magnetic field gradient source for the microfluidic devices and methods described herein can include iron, nickel, cobalt, alloys of rare earth metals, naturally occurring minerals such as lodestone, and any combinations thereof.

The magnetic field can be generated by an electromagnet. The field can be generated by dynamically changing the voltage/electric field applied to the electro-magnet allowing transient variation of the magnetic field. Both amplitude and frequency of the voltage/electric-field can be altered for optimizing the capture efficiency. Such optimization though is not possible with a permanent magnet.

In another aspect, the magnetic microbeads capture is better controlled in dynamic/transient manner when an electro-magnet is used in place of a permanent magnet. Improved capture of beads can be achieved by dynamically changing the voltage/electric field applied to the electro-magnet allowing transient variation of the magnetic field. Both amplitude and frequency of the voltage/electric-field is altered for optimizing the capture efficiency. Such optimization though is not possible with a permanent magnet.

The flow profile for an electroosmotic flow is uniform or flat as the flow slips over the charged surfaces of a microchannel. This unique uniform profile is very different than typical parabolic profile observed for pressure driven flow that does not allow slipping of fluid on channel surface. For the uniform profile for electroosmotic flow of the beads are well distributed across microchannel cross-section allowing more available beads for capture at the wall region close to the magnet/electro-magnet. In case of a parabolic flow, the beads are either at the bottom of the channel due to gravitational force or clustered at the central core of the channel due to the Fahraeus-Lindqvist effect, which is the effect due to the decrease in apparent viscosity occurring when a suspension, such as blood, is made to flow through a tube of smaller diameter; exemplarily observed in tubes less than about 0.3 mm in diameter, as for the present invention. Consequently, the bead capture for pressure driven parabolic flow is significantly less as beads are prone to escape the microchannel than electroosmosis driven uniform flow. More importantly capture efficiency of beads further improves when the electroosmotic flow is allowed to oscillate between inlet and outlet reservoir. Therefore, when oscillatory flow effect is in addition to the electroosmotic flow, the capture efficiency of beads significantly enhances. It can be interpreted that the device orientation in relation to the placement magnet/electromagnet and fluorescent/optical detectors are unique. This unique arrangement in combination of oscillatory-electroosmotic flow (EOF) allows improved capture of magnetic beads at the top-surface of the microchannel while detection is achieved from the bottom.

In an aspect, the invention discloses a method of enhancing the capture efficiency of microfluidic devices for a target reagent in a fluid medium, the method comprising:

a) providing a microfluidic device comprising at least one microfluidic channel, the at least one microfluidic channel comprising a first end and a second end;

b) generating a first electroosmotic force sufficient to cause the fluid medium comprising the target reagent to flow within the at least one microfluidic channel in a first flow direction and sustaining the first electroosmotic force at least until a steady state plug profile of the fluid medium is attained;

c) generating a second electroosmotic force sufficient to cause the fluid medium comprising the target reagent to flow within the at least one microfluidic channel in a second direction and sustaining the second electroosmotic force at least until a steady state plug profile of the fluid medium is attained, wherein the second direction is the reverse of the first direction;

d) applying a magnetic field externally to the at least one microfluidic channel, thereby generating a magnetic force for capturing the target reagent in the at least one microfluidic channel with the magnetic field; and e) reversing the magnetic field applied in step d) externally to the at least one microfluidic channel, thereby generating a transient variation in magnetic force for capturing the target reagent in the at least one microfluidic channel with the magnetic field.

The foregoing description is illustrative of particular aspects of the invention, but is not meant to be a limitation upon the practice thereof. In order that various aspects may be more readily understood, reference is made to the following examples which are intended to illustrate various aspects, but do not limit the scope thereof.

EXAMPLES

The following symbols are used throughout the Examples:

$A_z$ Magnetic vector potential, Wb/m
B Magnetic field intensity, Wb/m$^2$ or T
CE Capture efficiency, %
d Switching distance, m
E Electric field, V/m
EOF Electroosmotic flow
$F_d$ Viscous drag force, N
$f_e$ Coulomb force, N
$F_g$ Gravitational force, N
$F_m$ Magnetic force, N
$F_t$ Brownian force, N
H Height of microchannel, μm
$H_c$ Magnetic coercive field, A/m
L Length of microchannel, μm
M Magnetization of NdFeB, A/m
$m_b$ Mass of mMB, kg
NdFeB Neodymium alloy
p Pressure, Pa
$r_b$ Radius of mMB, m
t' Switching time, s
$U_e$ EOF velocity magnitude, m/s
V Fluid velocity, m/s
$v_b$ Velocity of mMB, m/s
Greek Symbols
ε Permittivity, C/V·m
ζ Zeta potential, V
$\lambda_D$ Debye layer thickness, μm
μ Dynamic viscosity of fluid, Pa·s
$\mu_o$ Magnetic permeability of vacuum, Wb/A·m
$\mu_r$ Relative permeability of NdFeB, unitless
ρ Fluid density, kg/m$^3$
$\rho_b$ Density of mMB, kg/m$^3$
$\rho_e$ Bulk charge density, C/m$^3$
τ Particle relaxation time, s
φ Applied EOF voltage, V
χ Susceptibility of mMB, unitless

Example 1: Materials and Methods of Numerical Model

Unless specified otherwise, the following experimental techniques were used in the Example 2, including the described the governing equations for magnetophoretic flow, the numerical schemes used to compute the trajectories of the magnetic microbeads, and the validation of the numerical model. The classical Navier-Stokes equation of fluid mechanics was modified to account for the influence of external electric field as a driving force for the flow. The transport of magnetic microbeads in the channel was affected by the flow field and the external magnetic field. The magnetic microbeads were tracked in the computational domain using Eulerian-Lagrangian approach. The primary figure-of-merit of our model, called the capture efficiency, was calculated as the ratio of the number of magnetic microbeads captured by the magnetic field to the number of magnetic microbeads injected through the channel inlet (Eq. 12).

Governing Equations

The governing equations for electroosmotic flow were derived based on the assumptions given in (Krishnamoorthy, S., Feng, J., Henry, A., Locascio, L., Hickman, J., and Sundaram, S., 2006, "Simulation and experimental characterization of electroosmotic flow in surface modified channels," Microfluid Nanofluid, 2(4), pp. 345-355) and (Comandur, K. A., Bhagat, A. A. S., Dasgupta, S., Papautsky, I., and Banerjee, R. K., 2010, "Transport and reaction of nanoliter samples in a microfluidic reactor using electroosmotic flow," J Micromech Microeng, 20(3), p. 035017), which are herein incorporated by reference, and are listed below:

Conservation of mass:

$$\nabla V = 0 \tag{1}$$

Conservation of momentum:

$$\rho \frac{DV}{Dt} = -\nabla p + \mu \nabla^2 V + f_e \tag{2}$$

Coulomb force:

$$f_e = \rho_e E \tag{3}$$

Poisson's equation:

$$\nabla^2 \varphi = 0 \tag{4}$$

Electric field:

$$E = -\nabla \varphi \tag{5}$$

where V represents the fluid velocity, ρ is the fluid density, μ is dynamic viscosity, φ is the applied potential, ε is the permittivity of fluid and E is the applied electric field. In the momentum equation (Eq. 2), $f_e$ represents the Coulomb force exerted by the external electric field. Additionally, the pressure drop term, ∇p, in our model was zero because a constant pressure was maintained at the inlet and outlet of the channel during electroosmotic flow in the channel. The Poisson's equation (Eq. 4) was then coupled with the momentum equation (Eq. 2). The electric field in the channel was solved using Eq. 5.

The governing equations for the magnetic field, velocity of the magnetic microbeads and the magnetic force experienced by them are given below:

Magneto-static equation:

$$M = \frac{B}{\mu_o \mu_r}(\mu_r - 1) \tag{6}$$

Magnetic force on magnetic microbead:

$$F_m = \frac{1}{2\mu_o}\chi\left(\frac{4}{3}\pi r_b^3\right)(B\nabla)\cdot B \tag{7}$$

Drag force on magnetic microbead:

$$F_d = 6\pi\mu r_b(V - v_b) \tag{8}$$

Newton's Second Law
(force balance on magnetic microbead):

$$\left(\frac{4}{3}\pi r_b^3 \rho_b\right)\frac{dv_b}{dt} = F_m + F_d + F_g + F_t \tag{9}$$

Velocity of magnetic microbead:

$$v_b = V + \frac{F_m}{6\pi r_b \mu} \tag{10}$$

Particle relaxation time:

Error! Objects cannnot be created from editing field codes. (11)

Capture Efficiency(%)

$$CE = \frac{\text{No. of } mMB \text{ captured by magnet}}{\text{No. of } mMB \text{ injected in channel}} \times 100 \tag{12}$$

where B represents the magnetic field intensity, M is the magnetization of NdFeB material, χ is the susceptibility of the magnetic microbeads, $F_m$ is the magnetic force, $\mu_o$ is magnetic permeability of vacuum, $\mu_r$ is relative permeability of NdFeB material, $F_d$ is the viscous drag force on the magnetic microbead, $v_b$ is the magnetic microbead velocity, $r_b$ the magnetic microbead radius, $\rho_b$ is the magnetic microbead density, and $m_b$ is the mass of the magnetic microbead.

Based on the equations above, several parameters such as the magnetic field strength and the external electric field driving the flow can be simulated and optimized for the design of an efficient magnetic microbead separator. In the instant model, the magnetic field was kept constant and the electric field was varied to evaluate the changes in capture efficiency, for a fixed design of the miniaturized magnet. The list of parameters used in our model and their quantitative values are listed in Table 1.

TABLE 1

List of properties used in the numerical calculations.

| Parameter | Value | Parameter | Value |
|---|---|---|---|
| Fluid density (ρ) | 997 kg/m$^3$ | EOF Electric field | 150-450 V/cm |
| Dynamic viscosity (μ) | 8.6 × 10$^{-4}$ Pa · s | Radius of mMB ($r_b$) | 1.42 μm |
| Relative permittivity ($\varepsilon_r$) | 78.8 | Density of mMB ($\rho_b$) | 1800 kg/m$^3$ |
| Zeta potential (ζ) | −95.6 mV | Susceptibility $(\chi)^t$ | 1.42 |
| Debye-layer thickness ($\lambda_D$) | 0.1 μm | Magnetic coercive field ($H_c$) | 9.79 × 10$^5$A/m |

Previous studies have shown that magnetic microbeads having a radius greater than 40 nm experience a significantly larger drag force ($F_d$) and magnetic force ($F_m$) compared to the Brownian force ($F_t$) and gravitational force ($F_g$). Also, based on the properties of the magnetic microbeads used in our model, the value of particle relaxation time (τ) was found to be significantly small, and consequently the term $dv_b/dt$ was nearly zero. Thus, Newton's Second Law simplified to $F_m+F_d=0$ or $F_m=-F_d$. The velocity of the magnetic microbeads, under the influence of the flow and magnetic fields, was computed using Eqs. 7-10. The magnetic microbeads are only affected by the flow field and magnetic field. The magnetic microbeads are not influenced by the electric field or the gradient of the electric field because they do not possess any electrical charge.

The magnetic field, simulated using a miniaturized magnet, was computed based on the properties of a typical neodymium (NdFeB) magnet. In our model, a one-way momentum coupling of the magnetic microbeads and fluid was asserted into the numerical method, i.e. the velocity of the fluid (V) affected the velocity ($v_b$) of the magnetic microbeads, but not vice versa. This condition was set based on a previous study (Khashan, S. A., and Furlani, E. P., 2012, "Effects of particle-fluid coupling on particle transport and capture in a magnetophoretic microsystem," Microfluid Nanofluid, 12(1-4), pp. 565-580), herein incorporated by reference in its entirety, which showed that imposing a one-way particle-fluid coupling to calculate the capture of magnetic particles provides a conservative estimate of capture efficiency in the dilute limit. The disadvantage, as outlined in this study, is that the one way coupled model may slightly over-predict the magnetic force needed to ensure particle capture when the results are compared with a fully coupled model.

Computational Model and Method

The two-dimensional computational domain, shown in FIG. 1, comprised of a miniaturized permanent magnet (150 μm×150 μm) and a microchannel (L×H=2000 μm×100 μm), surrounded by air. Although the length scale of typical microchannels is in the range of 1-5 cm, we have simulated a small section of this channel (2 mm) which is in close proximity to the miniaturized magnet. Considering the complex and coupled equations (Eq. 1-10) being solved in the presented model, the aspect ratio of the grid was kept close to 1. Due to this requirement, a truncated section of the device was simulated, while capturing the physics of magnetic microbead capture. A truncated domain of the device was used to keep the number of numerical elements manageable and within the available RAM power of the computer used for the simulations. Air accounted for the intermediary space between the miniaturized magnet and the channel and allowed the computation of magnetic field in that space. The numerical domain (FIG. 1) was meshed using structured mesh having 36,000 nodes with a grid spacing of 3.5 μm and an aspect ratio of ~1.

The dimensions of the miniaturized NdFeB magnet in the instant model were on the same scale of magnets simulated in previous studies by other researchers ((Gassner, A. L., Abonnenc, M., Chen, H. X., Morandini, J., Josserand, J., Rossier, J. S., Busnel, J. M., and Girault, H. H., 2009, "Magnetic forces produced by rectangular permanent magnets in static microsystems," Lab Chip, 9(16), pp. 2356-2363) and (Munir, A., Wang, J., and Zhou, H., 2009, "Dynamics of capturing process of multiple magnetic nanoparticles in a flow through microfluidic bioseparation system," IET Nanobiotechnology, 3(3), pp. 55-64)), herein incorporated by reference in their entirety. However, the magnetic field intensity within the microchannels in the presented model was much smaller compared to these studies, as shown in Table 2. The increased distance between the magnet and channel, and consequently, the reduce magnetic field intensity in the current model was to demonstrate the efficacy of the switching technique when using miniaturized magnets in a portable device with sufficient spacing between the magnet and microchannels.

TABLE 2

Comparison of magnetic field intensity of miniaturized NdFeB magnets in capture of mMBs in a microchannel

| Dimensions | Distance between magnet and channel | Magnetic field intensity (T) at channel wall | Source |
|---|---|---|---|
| 150 μm × 150 μm | 750 μm | 0.0084 T | Current Model |
| 200 μm × 200 μm | 50 μm | 0.35 T | Gassner et al. 2009 [18] |
| 20 μm × 60 μm | 0 μm | 1.1 T | Munir et al. 2009 [19] |

The numerical calculations on the two-dimensional computational model were performed using a finite-volume solver (ESI-CFD, 2010, "CFD-ACE+ Modules Manual V2010,"). The velocity field in the microchannel was solved using the modified Navier-Stokes equation (Eq. 2) which included the Coulomb force due to the applied electric field (Eq. 3). The magnetic field was solved using the magnetostatic equation (Eq. 6). The convergence criterion for residuals in the simulations was set to $1\times10^{-6}$. The converged solution of velocity and magnetic fields was then used to compute the magnetic force and drag force on the magnetic microbeads. The boundary conditions for the electroosmotic flow and magnetic field are shown in FIG. 1. The boundary conditions for driving the EOF i.e. zeta potential ($\zeta$) and Debye layer thickness ($\lambda_D$), were applied to the walls of the microchannel (solid-fluid interface in FIG. 1). The voltage driving the EOF was specified at the inlet and outlet of the channel. The magnetization of NdFeB was specified initially for the magnetic volume and an extrapolation boundary condition was applied at the walls for computing the magnetic field.

Figure 2:
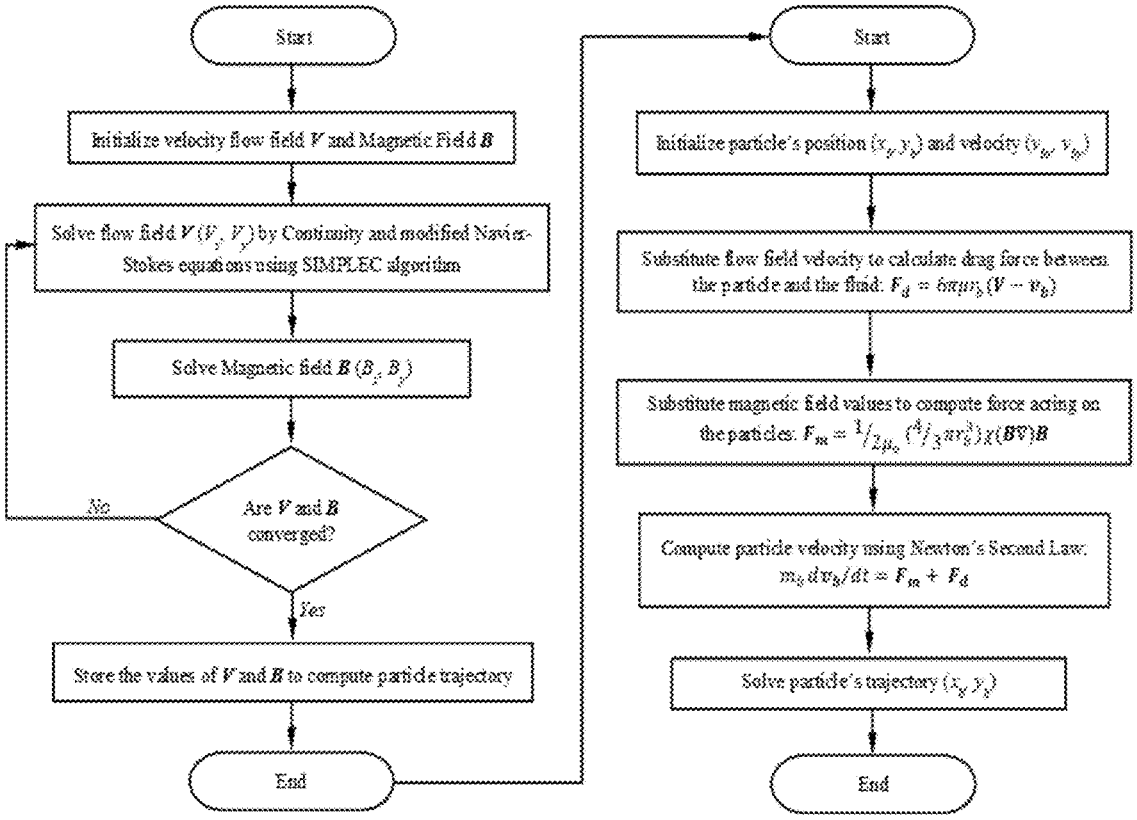
FIG. 2. The numerical method to compute magnetic microbead trajectory using finite-volume method.

For each simulation, a fixed number of magnetic microbeads (20) were injected into the microchannel from the inlet. The magnetic microbeads were modeled as discrete phases (or microparticles) using the spray module of the solver and were injected uniformly from the inlet. From the values of magnetic force and drag force, the trajectories of the magnetic microbeads were computed using Newton's second law (Eq. 9) in a Lagrangian frame of reference. The CE of the microfluidic device, based on the number of magnetic microbeads injected and the number of magnetic microbeads that escaped through the outlet was computed using Eq. 12. A flow chart of the overall algorithm used to compute the magnetic microbeads trajectories is illustrated in FIG. 2. The region in the channel where the magnetic microbeads were immobilized was referred to as the capture zone.

For electroosmotic force driven by a steady electric field, the input electric field (150-450 V/cm) was applied at the channel inlet while the outlet was set to ground (0 V). For flow with sequential switching, the boundary conditions for the electric field were reversed periodically, i.e. the inlet was set to ground and the outlet was set to the applied electric field (150-450 V/cm). The Debye layer thickness was set to 0.1 μm and the zeta-potential was set to −95.6 mV. This value of zeta potential was based on experimental values obtained from PDMS-glass microchannels in our laboratory (Al-Rjoub, M. F., Roy, A. K., Ganguli, S., and Banerjee, R. K., 2011, "Assessment of an active-cooling micro-channel heat sink device, using electro-osmotic flow," Int J Heat Mass Transfer, 54(21), pp. 4560-4569, herein incorporated by reference in its entirety) and was similar to the values reported in literature, shown in Table 3. The magnetic field in the computational domain was simulated from the input values of intrinsic magnetic microbead susceptibility ($\chi$) equal to 1.42 and magnetic coercive field ($H_c$) of the permanent neodymium magnet (NdFeB) equal to $9.79\times10^5$ A/m. For the magnetic field, extrapolation boundary condition was applied in the computational domain.

TABLE 3

Comparison of zeta potential values with the literature

| Channel Type: | Zeta Potential Value | Source |
|---|---|---|
| PDMS-Glass | −95.6 mV | Current Study |
| PDMS-Glass | −110 mV to −68 mV | Sze et al. 2003 |
| PDMS-Glass | −92 mV to −49 mV | Almutairi et al. 2009 |
| Fluoropolymer-Glass | −97 mV to −42 mV | Werner et al. 1998 |
| PDMS-Silica | −95 mV | Al-Rjoub et al. 2011 |

Validation of Simulation Results

Validation of Electroosmotic Flow Velocity.

Figure 3:
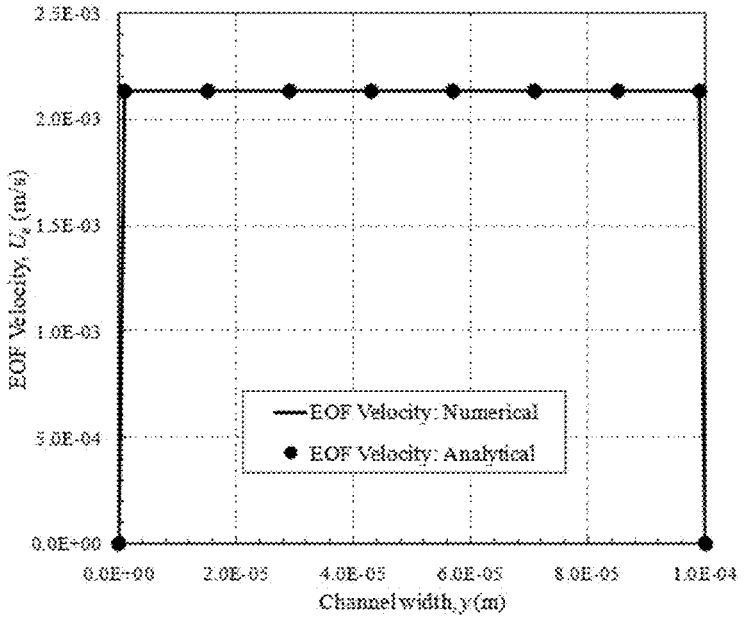
FIG. 3. Comparison of numerically-calculated electroosmotic flow profile with analytical solution of Helmholtz-Smoluchowski equation (Electric field applied: 275 V/cm).

When electroosmotic flow is driven by a uniform electric field in a channel, the flow field will have a plug profile. The analytical solution for steady-state electroosmotic flow, given by the Helmholtz-Smoluchowski (H-S) equation (Eq. 13), correlates the applied electric field, zeta potential of the channel wall ($\zeta$), fluid permittivity and viscosity to the magnitude of EOF velocity ($U_e$). This analytical solution is used to validate the velocity vector (V) computed by Eq. 2 in the finite volume solver (FIG. 3). As a baseline analysis, we numerically evaluated the velocity profile of a fully-developed electroosmotic flow in the channel using the finite-volume solver. As shown in FIG. 3, the numerical solution, for an applied electric field of 275 V/cm, agreed within 0.1% of the analytical EOF profile given by the H-S equation (Eq. 13).

$$\text{Helmholtz-Smoluchowski } (H\text{-}S) \text{ Eq.: } U_e=\varepsilon\zeta E/\mu \quad (13)$$

Validation of Magnetic Field.

Figure 4:
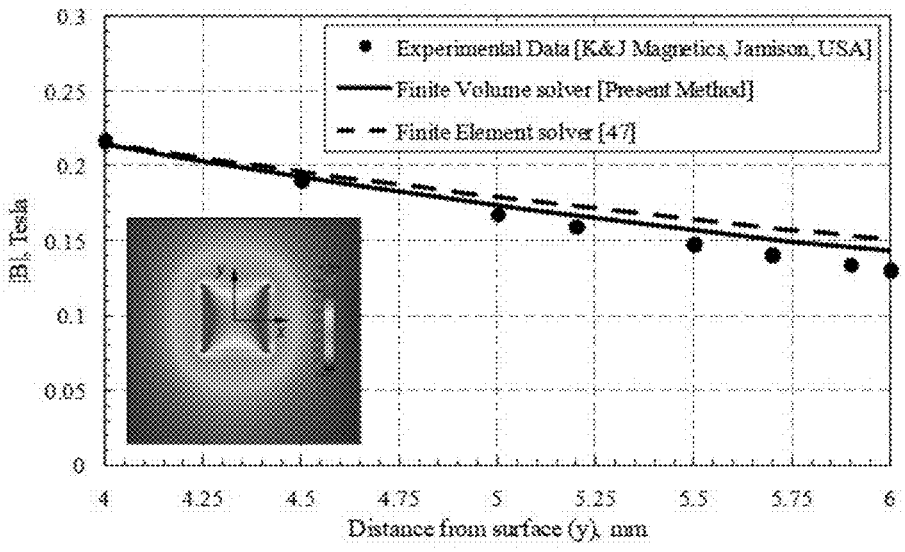
FIG. 4. Magnetic field produced by ⅜" cubic neodymium magnet: comparison between experimental data (K&J Magnetics, Jamison, Pa., USA), Finite Volume solver (CFD-ACE+) and Finite Element solver (FEMM); Inset: Magnetic field contour, |B|, computed by the finite volume solver.

The magnetic field, computed by the solver, was validated with experimental data and by a finite element solver. In order to compare and validate the magnetic field computed by the finite volume solver, we used the experimental data for a ⅜" cubic neodymium (NdFeB) magnet (K&J Magnetics, Jamison, Pa., USA) and numerical results using a finite element solver called Finite Element Method Magnetics (FEMM). The magnet was assumed to be magnetized along the y-axis in the computational domain. The variation of the magnetic field intensity was plotted from the surface of the magnet. As shown in FIG. 4, the results obtained from the finite-volume solver compared well with both the experimental data and the finite element solver. The maximum error in the computational results with respect to experimental data and finite element solver (at y=6 mm) was 5.1% ($[|0.138_{Finite\ Volume}-0.131_{Experiment}|\times 100/0.138_{Finite\ Volume}]$%) and 7.3% ($[|0.138_{Finite\ Volume}-0.148_{Finite\ Element}|\times 100/0.138_{Finite\ volume}]$%), respectively.

Validation of Model Grid Independence.

Figure 5:
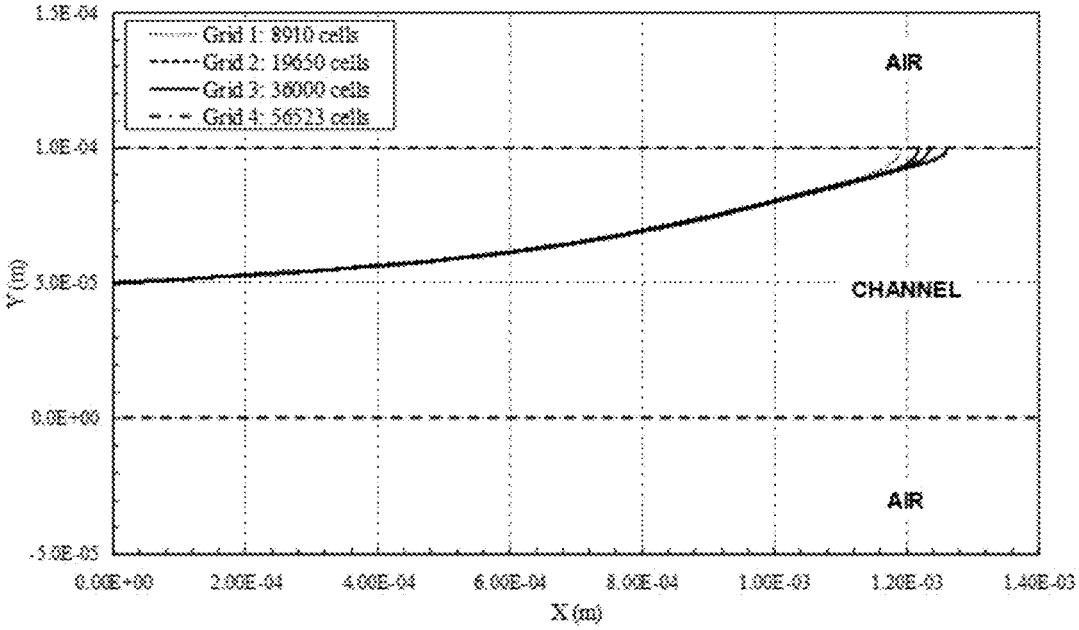
FIG. 5. The magnetic microbead trajectory for applied electric field of 200 V/cm, demonstrating grid independent results for the computational model, shown for a section of the numerical domain.

In order to demonstrate the grid independence of our model, the trajectory of a single magnetic microbead was plotted when released from the center of the channel under an applied electric field of 200 V/cm. As shown in FIG. 5, grid independence was tested for four mesh configurations having: (1) 8,910, (2) 19,650, (3) 36,000, and (4) 56,523 cells. The trajectory of the captured magnetic microbead was similar in all the four mesh configurations tested. This trajectory was quantified based on the final position (x coordinate) of the magnetic microbead on the upper wall of the channel (y=100 μm). The final x coordinate of the magnetic microbeads at y=100 μm were 1189.2 μm, 1219.7 μm, 1235.8 μm and 1260.5 μm for Grids 1, 2, 3, and 4, respectively. Accordingly, the average difference in this final x coordinate (at y=100 μm) with respect to Grid 3 was 2.36% ($[3.77_{Grid\ 1}+1.31_{Grid2}+2.00_{Grid4}]$%/3). Grid independent results obtained for the current mesh (Grid 3: 36,000 nodes) were used for subsequent simulations. This grid size enabled simulations of complex steady-state and transient coupled electric, magnetic, and fluid flow fields for capture of magnetic microbeads.

Example 2: Results of Numerical Model

The magnetic field that immobilizes the magnetic microbeads, the electric field that drives the flow and their coupled effects on the capture efficiency of the magnetic microbeads in the microchannel are discussed in this section. First, the magnetic field generated by a miniaturized magnet placed above the microchannel and its effects on the trajectory of magnetic microbead transported within the channel are described. Second, the capture efficiency of the a microfluidic device for the magnetic microbeads using electroosmotic flow is characterized under two applied electric field conditions: (a) steady electric field (constant inlet electric field, outlet grounded) and, (b) electric field altered by sequential switching of applied potential at inlet and outlet. The enhancement of capture efficiency by the periodic changes in flow direction, caused by switching, is discussed in further detail. The characteristics of the electroosmotic flow velocity profile are also assessed for flows driven by steady and sequentially switched electric field.

Effect of Magnetic Field

Figure 6:
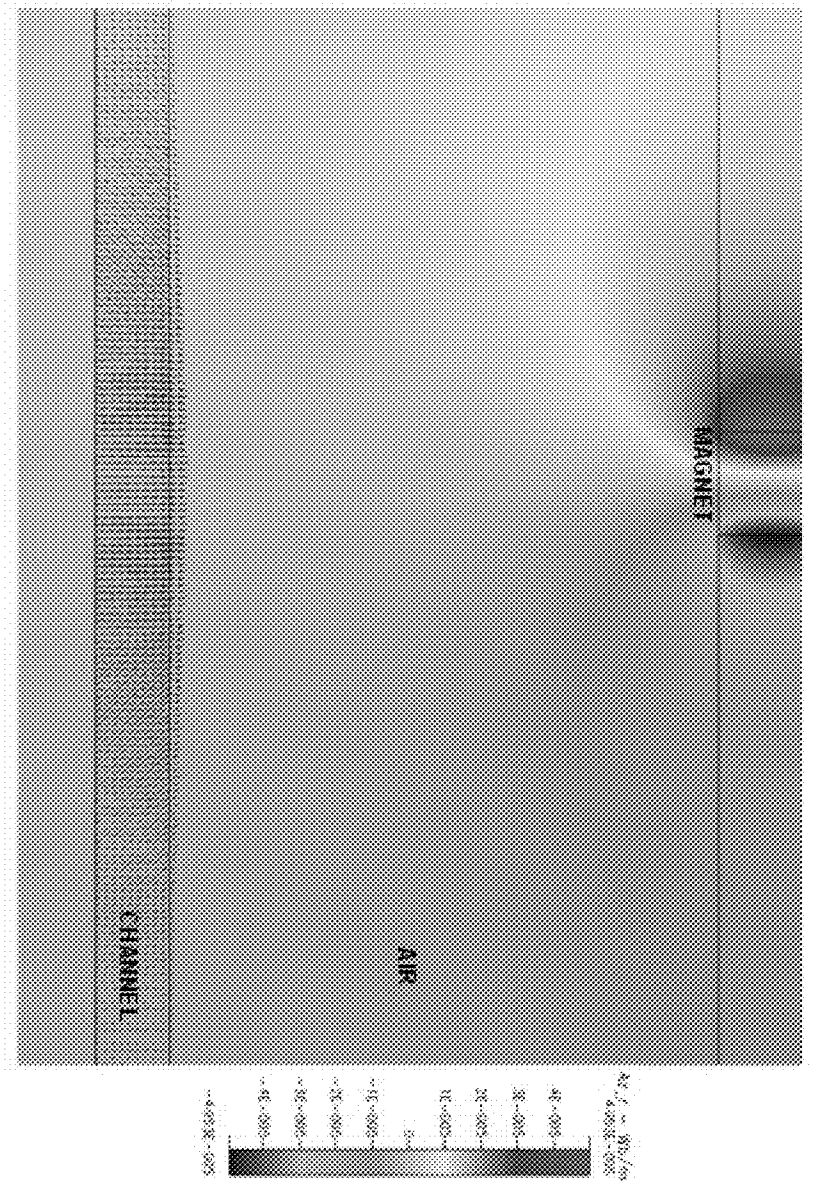
FIG. 6. Variation of magnetic vector potential ($A_z$) in the computational domain and magnetic force vectors in the microchannel.

The magnetic field produced by permanent earth magnets, such as neodymium (NdFeB), have been found to be effective in immobilizing magnetic microbeads in millitubes during immunoassays. FIG. 6 shows the magnetic field contours around a microchannel when simulated using the properties of NdFeB miniaturized magnet. From the surface of the magnet, the magnetic field decreases exponentially in space. The magnetic field strength used in this study is significantly lower than the ones reported in previous studies (Table 2). The magnetic force exerted due to the external magnetic field is critical in determining the number of magnetic microbead immobilized in the microchannel. To study the effect of this force on the trajectory of the magnetic microbead, 20 magnetic microbeads, equally-spaced along the inlet, were injected into the microchannel.

Figure 7:
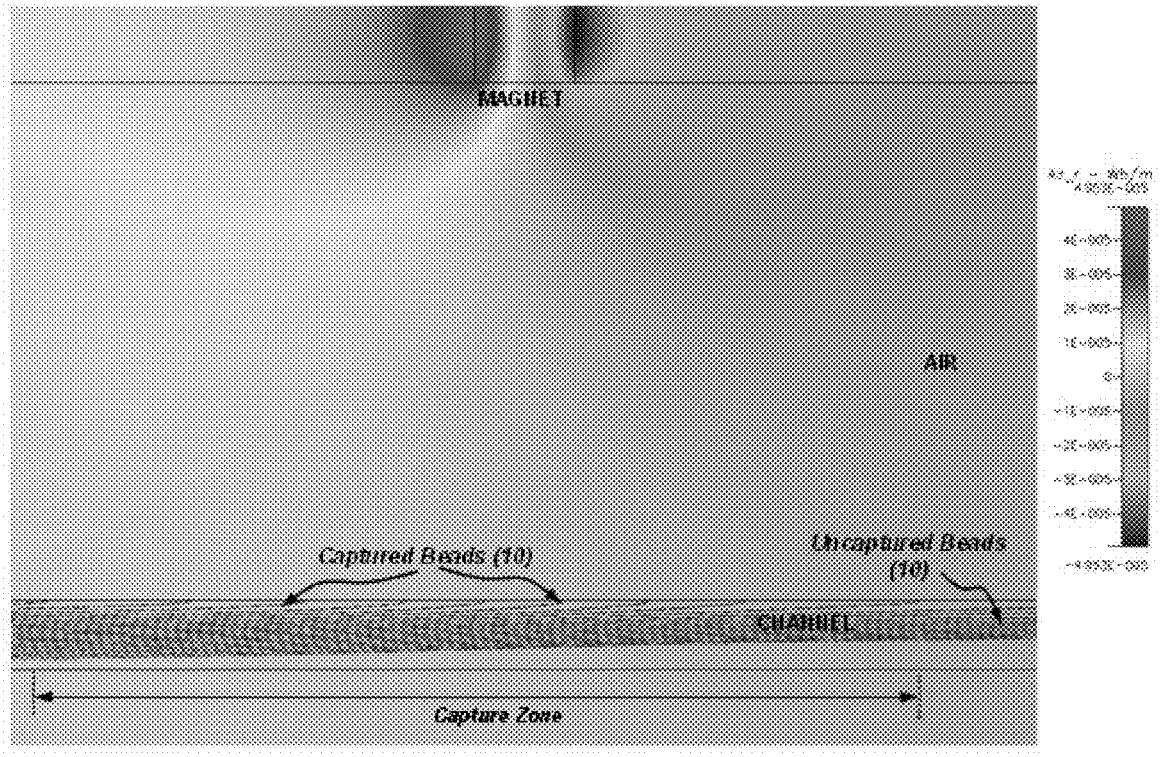
FIG. 7. Trajectory of magnetic microbeads under the influence of a magnetic field, for an applied electric field of 275 V/cm without switching the electroosmotic flow.

As an example, the trajectory of the magnetic microbeads is plotted for an applied EOF electric field of 275 V/cm (FIG. 7). Out of the 20 magnetic microbeads injected, 10 were captured by the magnetic field. Since the magnetic force, similar to the magnetic field, decays as one moves away from the surface of the miniaturized magnet, the magnetic microbeads injected from the top of the channel (closer to the magnet) were more susceptible to being captured than those injected from the bottom. Therefore, the remaining 10 magnetic microbeads, injected near the bottom of the channel, overcame the force exerted by the magnet and eventually reached the outlet. For an applied electroosmotic flow electric field of 275 V/cm, the capture efficiency was calculated using Eq. 12, was 50%.

Capture Efficiency without Switching

Figure 8:
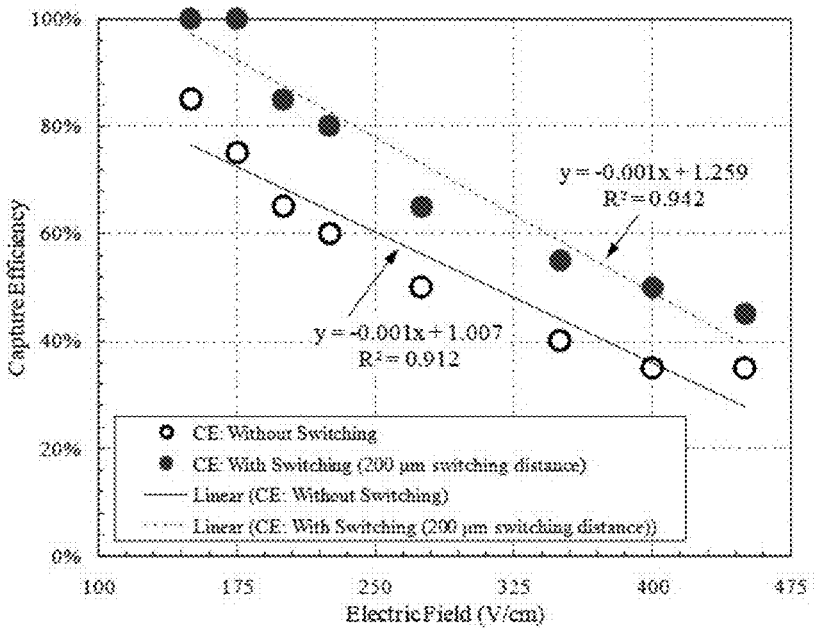
FIG. 8. Capture efficiency for electroosmotic flows with and without switching the electroosmotic flow.

The capture efficiency at an applied electroosmotic flow electric field was evaluated for the without switching case by keeping the polarity of electric field constant at the inlet and outlet of the microchannel. At all times during the simulations the electroosmotic flow had a plug profile. The capture efficiency of the system decreased with increase in electroosmotic flow electric field driving the flow (FIG. 8). This decrease was because of increase in fluid velocities at higher electric fields (from Eq. 13, $U_e \propto E$). With the increased flow rates, the magnetic microbeads in the channel acquired higher momentum. Consequently, the magnetic microbeads escaped through the outlet after overcoming the stronger magnetic force in the capture zone. For the without switching case (steady electric field), the maximum capture efficiency obtained was 85% at 150 V/cm. The average capture efficiency at lower electric fields (150-200 V/cm) was 75% ($[85_{150V/cm}+75_{175V/cm}+65_{200V/cm}]$%/3). At higher electric fields (400-450 V/cm), this average decreased to 35% ($[35_{400V/cm}+35_{450V/cm}]$%/2).

Variation of Electroosmotic Flow Field During Switching

Dynamics of the Debye Layer.

As discussed earlier, a fully developed electroosmotic flow velocity in a microchannel has a plug profile and its magnitude is governed by the H-S equation ($U_e$, Eq. 13). When the electric potential between the inlet and outlet of the microchannel was reversed, the flow was first altered within a small region near the Debye layer. This flow reversal near the Debye layer was due to the instantaneous response of the counter ions, concentrated near the Debye layer, to the changed electric field. The motion of these ions affected the fluid flow in their immediate vicinity and this localized flow reversal was in the direction of the applied electric field but against the flow field in the core of the channel. The subsequent flow reversal in the core region of the microchannel was delayed due to the existing inertia of the fluid in the core region of the microchannel against the applied electric field. Eventually, the fluid in the core region was reversed by the counter-ions in the Debye layer responding to the switched electric field.

Electric Field and Velocity Variation During Switching.

Figure 9:
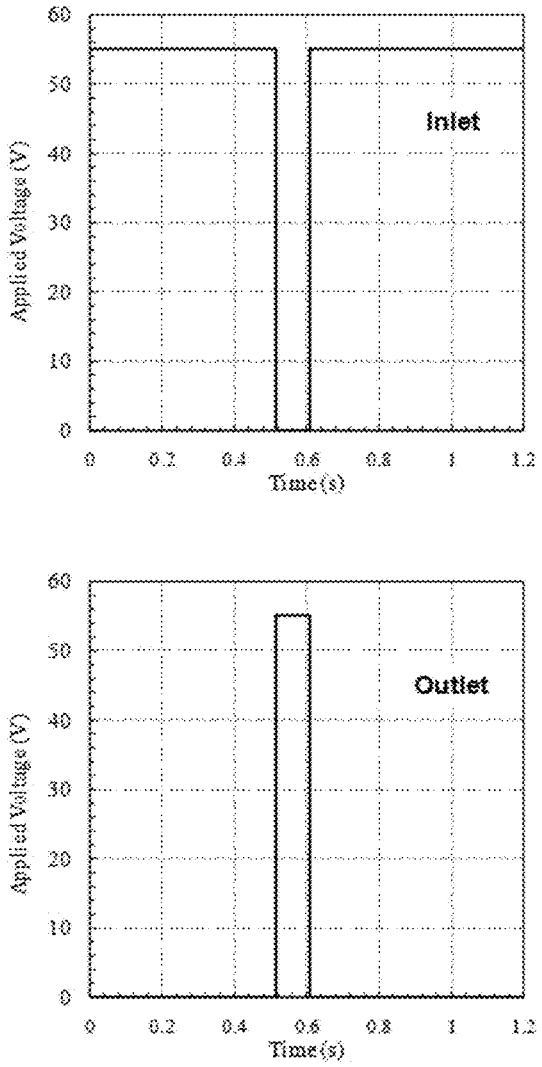
FIG. 9. Voltage signal at the inlet and outlet reservoir of the microfluidic channel to create switching of the electroosmotic flow in the channel for an applied voltage potential of 55 V (corresponding to electric field of 275 V/cm).

To study the effect of switching on capture efficiency, the applied voltage potential was reversed and the duration of this reversal was varied. Reversing the polarity at the inlet and outlet terminals led to the switching of the flow direction within the channel. It also caused the magnetic microbeads to travel in reverse direction towards the inlet for the duration of the switching or electric field reversal. The potential was switched when the uncaptured magnetic microbeads began to pass the capture zone moving towards the outlet. The distance travelled by the magnetic microbeads during the electric field reversal was proportional to the duration of switching. As shown in Table 4, the flow was initialized with the potential at the inlet set to the applied electric field (275 V/cm) and the outlet kept at ground (0 V) from t=0 sec to t=0.51 sec. When the electric potentials at the inlet and the outlet were reversed from t=0.51 sec to t=0.61 sec, a reversal in flow direction was achieved, i.e. the flow was switched. For an applied electric field of 275 V/cm, the corresponding voltage signals at the input and the output terminals are shown in FIG. 9.

TABLE 4

Applied electric field conditions for sequential switching of flow

| | Electric Field (V/cm) | |
|---|---|---|
| Time (sec) | Inlet | Outlet |
| 0.0-0.51 | 275 | 0 |
| 0.51-0.61 | 0 | 275 |
| 0.61-1.2 | 275 | 0 |

Figure 10:
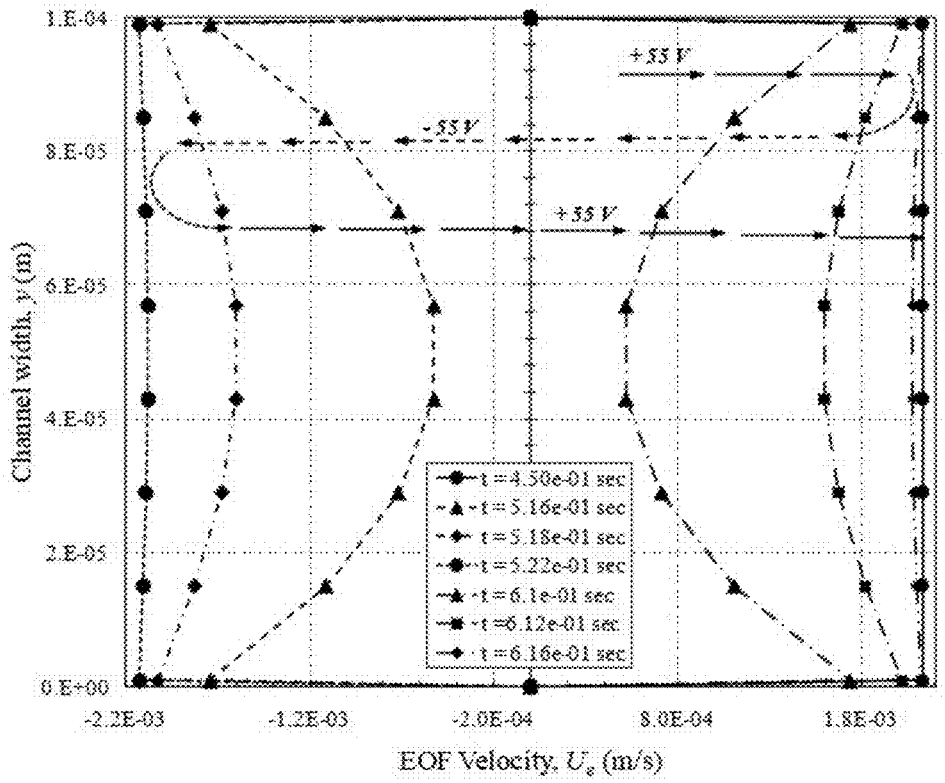
FIG. 10. Variation of electroosmotic flow profile during switching an applied voltage of 55 V (corresponding to electric field of 275 V/cm).

FIG. 10 shows an example of the axial velocity profile for an applied electric field of 275 V/cm (corresponding to an electroosmotic flow voltage of 55 V across 2 mm), before the flow was switched (inlet at 275 V/cm, outlet at ground: indicated by arrows showing +55 V), and after the flow was switched (outlet at 275 V/cm, inlet at ground: indicated by arrows showing −55 V).

Forward flow (inlet at 275 V/cm, outlet at ground): Initially (t=0 sec to t=0.51 sec) the EOF had a plug profile with the axial velocity equal to $2.13\times10^{-3}$ m/s in the forward direction (+x).

Backward flow (inlet at ground, outlet at 275 V/cm): When the electric field was switched at t=0.51 sec, the flow in the Debye layer immediately aligned itself with the direction of the applied electric field (−x). However, at this instance, the velocity in the core of the channel still had a magnitude of ~$2.13\times10^{-3}$ m/s in the direction (+x) opposite to the reversed electric field (−x). Eventually, the flow in the Debye layer overcame the momentum in the core towards the direction of the electric field (−x); thus, completely overcoming the forward (+x) inertia of the fluid within the channel.

Forward flow (inlet at 275 V/cm, outlet at ground): When the flow was switched back at t=0.61 sec in the +x direction, the ions in the Debye layer again reversed the flow from −x direction to the direction of applied electric field (+x). About $6\times10^{-3}$ sec after switching, a steady state velocity field was attained in the +x direction.

Capture Efficiency with Switching

Capture Efficiency with Switching Compared to without Switching.

For flow without switching, the capture efficiency decreased with an increase in electric field. A similar trend was observed for flow with switching. However, for the same magnitude of applied electric field, switching the flow led to an increase in the CE (FIG. 8). The initial results of capture efficiency with switching indicated that the magnetic microbeads which initially escaped the magnetic field could be captured if the flow field was reversed. At lower electric field (150-200 V/cm) the capture efficiency with switching increased to 95% ($[100_{150V/cm}+100_{175V/cm}+85_{200V/cm}]\%/3$) compared to 75% for flow without switching. At higher electric field (400-450 V/cm), the capture efficiency increased from 35%, for flow without switching, to 47.5% ($[50_{400V/cm}+45_{450V/cm}]\%/2$) for flow with switching. The enhancement in capture efficiency due to switching was significant and was further investigated by varying the duration of electric field reversal.

Enhancement of Capture Efficiency by Increased Switching Distances.

To further enhance the capture efficiency with switching, we increased the time period for which the polarity at the inlet and outlet terminals was reversed. This time period (t') was based on the time it took for a particle to travel a given distance (d) in the backward (−x) direction (towards inlet). The time ($t'=d/U_e$) was calculated at each electric field (150-450 V/cm) for a specified distance (d=200 μm [Case A], 300 μm [Case B], and 450 μm [Case C]) using the corresponding values of electroosmotic flow velocity ($U_e$). When the period of switching was prolonged, the residence time of the magnetic microbeads in the capture zone increased. For example, at an electric field of 275 V/cm, increasing the distance traveled by the magnetic microbeads in the backward direction (d) from 200 μm to 450 μm increased the residence time (t') from $9.4\times10^{-2}$ sec to $2.1\times10^{-1}$ sec. This allowed the magnetic force to exert its effect on the magnetic microbeads in the capture zone for a longer period to overcome the momentum of the magnetic microbeads. Due to this increased period of switching, the corresponding capture efficiency increased from 65% to 80%. During this switching, velocity magnitude momentarily acquired a nearly zero value. Consequently, the magnetic force was able to pull the magnetic microbeads closer to the regions of strong magnetic fields under the reduced forward (+x) inertia of the fluid. The increased residence time and momentary drop in the velocity of the magnetic microbeads resulted in an improvement of capture efficiency by the increased duration of the period of switching.

Relative Increase in Capture Efficiency for Varying Switching Distances.

Figure 11:
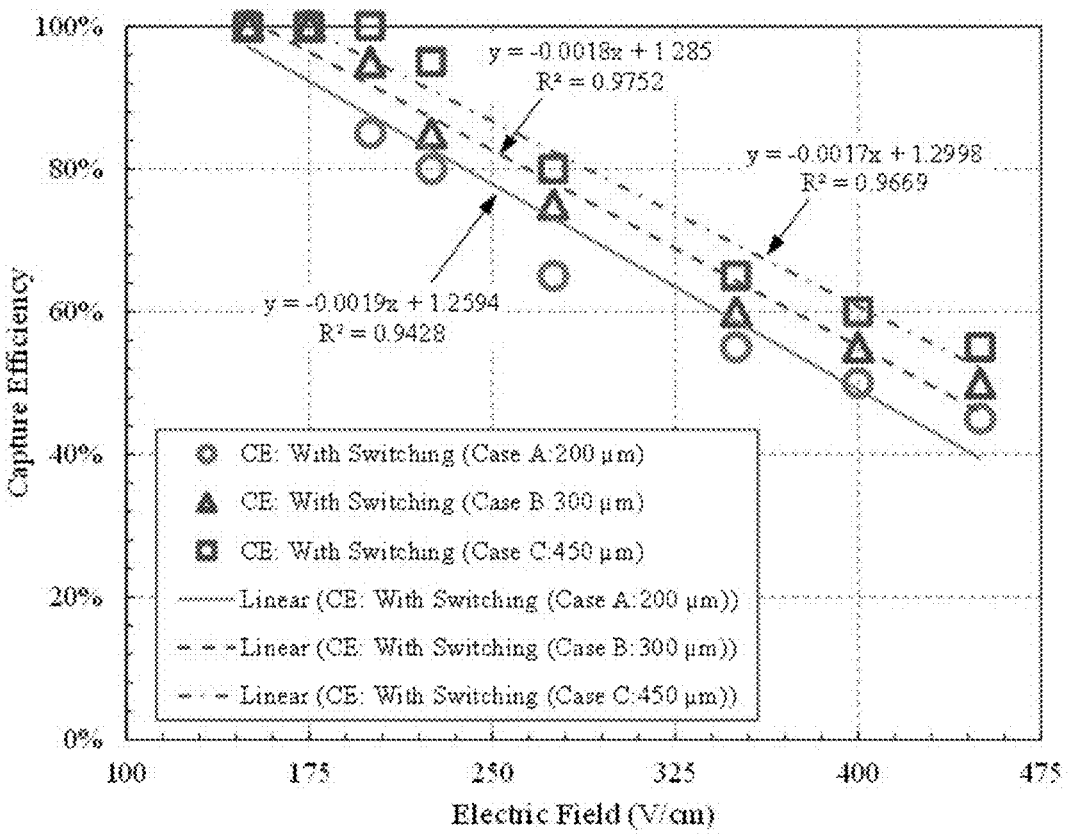
FIG. 11. Capture efficiency under the effect of variable periods of switching the electroosmotic flow.

As can be inferred from FIG. 11, a longer period of switching caused an increase in the capture efficiency for all applied electric fields. The average capture efficiency at lower electric field (150-200 V/cm), for all switching distances, was 97.8% (150 V/cm: 100%, 175 V/cm: 100%, 200 V/cm: 93.3%). This average value of capture efficiency decreased to 73.3% (225 V/cm: 86.7%, 275 V/cm: 73.3%, 350 V/cm: 60%) at intermediate electric field (225-350 V/cm) and was 52.5% (400 V/cm: 55%, 450 V/cm: 50%) at higher electric field (400-450 V/cm). As the switching distance was increased, the effect of relative increase in capture efficiency was more profound at higher electric fields. At lower electric field (150-200 V/cm), the average increase in capture efficiency (with respect to the capture efficiency in Case A) was 8.1% (150 V/cm: 0%, 175 V/cm:

0%, 200 V/cm: 14.7% increase). At intermediate electric field (225-350 V/cm) the relative increase in capture efficiency was 15.1% (225 V/cm: 12.5% increase, 275 V/cm: 19.2% increase, 350 V/cm: 13.6% increase), which further increased to 15.8% (400 V/cm: 15% increase, 450 V/cm: 16.7% increase) at higher electric field (400-450 V/cm). The similar values of slope for the linear correlations (FIG. 11) showed that effect of electric field on capture efficiency remained generally similar for different switching distances.

Example 3: Discussion of Results of Numerical Model

Unique methods have been developed to immobilize functionalized magnetic microbeads for microfluidic immunoassays. However, very few studies have focused on the improvement of capture efficiency of the devices to minimize the loss of samples and reagents [6]. Most pressure driven microfluidic systems employ external pumps such as syringe pumps. The use of electroosmotic flow for the magnetic microbead immobilization systems has not been explored extensively. The present numerical model studied the effects of steady and switched applied electroosmotic flow electric field on the capture efficiency of a microfluidic device for a magnetic microbeads, by simulating micron-sized permanent magnets under reduced magnetic field strength. These magnets have potential application when integrated in miniaturized devices. The study showed that the flow direction can be changed using periodic switching of electroosmotic force which can significantly improve the capture efficiency of a microfluidic device for a magnetic microbeads. Such switching of the applied electric field also enabled better control over flow rate and its direction. Additionally, the plug profile of electroosmotic flow ensured uniform distribution of magnetic microbeads in the flow through the microchannel. The rationale behind switching of the electroosmotic flow, was to increase the residence time of the mMB in the region of higher magnetic fields. This was achieved by changing the direction of applied electric field, causing escaped magnetic microbeads (microbeads that initially escaped the applied magnetic field, to return to the capture zone of the magnetic field. The numerical results also showed that flow reversal significantly improved the capture efficiency (FIG. 11) as discussed in further details below.

Effect of Steady and Switched Electroosmotic Flow Electric Field on Magnetic Microbead Capture To improve throughput of the microfluidic devices, higher flow rates are desired. However, such higher flow rates lead to loss of samples and reagents, such as magnetic microbeads that escape the magnetic field due to higher momentum. In the present study, the capture efficiency decreased with increase in applied electric field in both steady electric field and with switching. FIG. 8 shows that the capture efficiency decreased linearly with the increase in applied electroosmotic force electric field. The trajectory of the magnetic microbeads in the microchannel was governed by the combined effects of flow field velocity, V, and the magnetic force term, ($F_m/6\pi r_b\mu$), shown in Eq. 10. The magnetic microbeads escaped when the fluid momentum was greater than the magnetic force in the momentum equation ($V>F_m/6\pi r_b\mu$). For the miniaturized magnet to capture the magnetic microbeads, the term $F_m/6\pi r_b\mu$ needs to be greater than fluid momentum.

The static magnetic field produced by the miniaturized magnet led to a constant magnetic force in the computational domain (FIG. 6). As a result, the magnetic microbeads could be captured if, (a) the magnetic microbeads were in a region of high magnetic field, and (b) if the EOF velocity of the fluid medium containing the magnetic microbeads was lower. For the flow without switching, the miniaturized magnet could immobilize the magnetic microbeads, only when the transverse (+y) magnetic force was greater than the force due to steady-state momentum of EOF in the axial direction (+x). The resultant velocity acquired by the magnetic microbeads ($v_b$) was due to the combination of forward (+x) electroosmotic flow force and transverse (+y) magnetic force components. The captured magnetic microbeads travelled in a region closer to the magnet and were immobilized due to the higher magnetic force. The magnetic microbeads which remained uncaptured didn't acquire sufficiently high transverse velocities due to relatively lower magnetic force away from the magnet. These magnetic microbeads failed to overcome the axial momentum exerted by the electroosmotic force and eventually escaped through the outlet.

In the case of switching, residence time increased due to deceleration of particles during reversal of the voltage potential. Due to the static magnetic field, the magnetic force in the channel remained constant, while the momentum due to the fluid velocity did decrease. The resultant magnetic microbead velocity ($v_b$), which was the combined effect of the magnetic force term ($F_m/6\pi r_b\mu$) and flow velocity (V) decreased due to the reduced flow velocity. Thus, the magnetic force in conjunction with the reversal of flow during switching reduced the net velocity of the captured magnetic microbeads in comparison to flow without switching. During the switching period, the magnetic force in the channel was able to overcome the reduced momentum of the flow field, thus, immobilizing additional magnetic microbeads which would have otherwise escaped. In addition to magnetic microbeads captured during the period of switching, some magnetic microbeads were also captured by the miniaturized magnet when the polarity was reinstated and forward flow was restored from the inlet to the outlet (inlet: applied electric field; outlet: ground). This was due to magnetic microbeads being pulled closer towards the magnet in the capture zone during the period of switching. As the flow attained its steady state plug profile, the higher magnetic force near upper wall of the microchannel was able to overcome the momentum of the flow field and immobilized additional magnetic microbeads. Most of the magnetic microbeads during switching were captured before the flow attained its steady state plug profile ($U_e$).

Advantages of Switching in Improving Capture Efficiency

Figure 12:
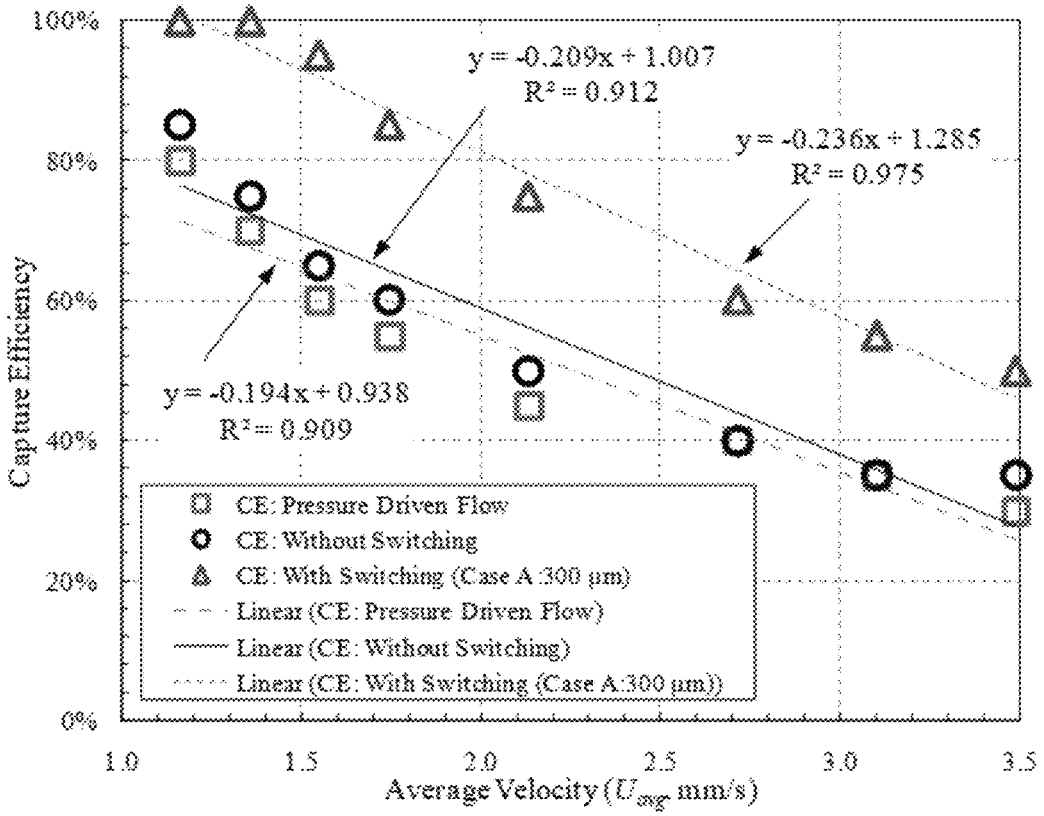
FIG. 12. Comparison of capture efficiency in pressure driven flow with electroosmotic flow with and without switching of the electroosmotic flow.

Previous designs demonstrating high capture efficiency were sometimes effective but required additional manufacturing steps or complex set-up of magnetic field in the channel. The method of electroosmotic flow switching can be implemented by using commercially available off-the-shelf systems allowing improved capture efficiency of a microfluidic device for a magnetic microbeads. Using electroosmotic flow power supplies, the polarity of the electrodes placed in the inlet and outlet reservoirs can be sequentially changed for altering the flow direction. Replicating the process of switching in pressure driven systems would require additional pumps, instrumentation and tubing which may not be trivial to setup. To compare the proposed method with conventional systems, capture of magnetic microbeads in a pressure driven flow was modeled (average velocity equal to $U_e$ for comparison), as shown in FIG. 12. The capture efficiency for pressure-driven flow was comparable to flow without switching, but was lower than what was obtained with electroosmotic flow switching.

Assumptions and Limitations of Numerical Model.

In this research, the computational model demonstrates the capture of mMBs tagged with antibodies. The binding kinetics of the target cells (antigens) with the immobilized microbeads (tagged with antibodies) and any flow of cell-microbead complex are not modeled in this study. Thus, this study evaluated the event of capture of mMBs tagged with antibodies in the microchannels, prior to the injection of cell samples. Also, our current computational model is based on certain assumptions. The model assumes that the particles are sufficiently small compared to channel width so that the fluid momentum is not significantly affected due to presence of the particles thereby neglecting the two-way coupling between particles and fluid. In two-way coupling, the interplay between the magnetic and particle-induced fluid momentum may enhance the capture efficiency. A superparamagnetic microbead when exposed to an external magnetic field generates an intrinsic magnetic field. This phenomenon enhances the magnetic field in the microchannel. As a result, the particles which may have escaped could be captured by weaker magnetic fields or their trajectories could be altered. The altered trajectory could primarily lead to magnetic microbeads being captured by the external miniaturized magnet and thus enhance the capture efficiency of the device. Also, particle-particle interactions were not modeled in the current numerical method. In this study, the magnetic microbeads were treated as discrete particles without their intrinsic magnetic fields. The particle collisions were not modeled. This assumption is generally valid for low concentration of particles. The magnetic microbeads sticking to the walls were assumed not to ricochet back into the flow field. We anticipate that these assumptions should not affect the accuracy of the simulations.

Despite the limitations in the model, the model demonstrated that sequential switching of electric field in electroosmotic flow under reduced magnetic field strength has the potential to minimize the loss of magnetic microbead samples and reagents in immunoassays. The optimization of sequential switching of electroosmotic flow in conjunction with reduced size of magnets, or magnetic field strengths, will help fabricate a device on a smaller scale and improve the portability as a hand-held monitoring unit for field testing.

The numerical model demonstrates a simple technique of sequential switching which can be used in electroosmotic flow systems for efficient capture of magnetic microbeads using miniaturized magnet. The unidirectional flow of magnetic microbeads from inlet to outlet in a steady electric field showed a linear decrease in capture efficiency with increase in applied electric field. The sequential switching of this electroosmotic flow electric field caused the direction of the flow field to reverse periodically, that led to an increase in capture efficiency due to the capture of the magnetic microbeads that initially escaped the magnetic field. The sequential switching of electroosmotic flow improved the capture efficiencies at both high (400-450 V/cm) and low (150-200 V/cm) electric field ranges evaluated by the model. The capture efficiency also improved significantly with increase in switching distances. The increase in capture efficiency was due to decreased velocity of flow field and increased residence time of magnetic microbeads in the capture zone. The improvements in capture efficiency were more significant at higher electric field (400-450 V/cm) where relative increase in capture efficiency due to prolonged period of switching was 15.8% compared to 4.9% at lower electric field (150-200 V/cm). The method of switching efficiently captured the magnetic microbeads and overcame the reduced magnetic field strength (T) in the channel due to the smaller size of the magnet. The technique of sequential switching of electroosmotic flow under reduced magnetic field strength can reduce the loss of samples and reagents during magnetophoretic immunoassays in high throughput microfluidic devices. In conclusion, the reduced size of magnet and magnetic microbeads capture with switching can enable the fabrication of efficient and portable devices for field testing.

Example 4: Materials and Methods of Experiments to Verify the Concept of Sequential Switching for Efficient Capture of Magnetic Microbeads Capture Efficiency for without Switching Case: Steady Electroosmotic Flow Voltage Conditions To study the capture efficiency of a microfluidic device for a magnetic microbeads (Dynabead® M280 Sheep anti-Rabbit IgG), fluorescent labeled (Alexa Fluor®) magnetic microbeads at a fixed concentration of 2×106 beads/ml (C) were injected into the inlet reservoir of a straight PDMS-glass rectangular microchannel. The PDMS-glass microchannel was fabricated using photolithography and PDMS casting. The electroosmotic flow within the microchannel was driven under four different inlet voltages of 500 V, 650 V, 750 V, and 900 V, with the outlet set at 0 V (ground). A permanent magnet (NdFeB) was placed above the microchannel for capturing the magnetic microbeads in this dynamic (flowing) system. For a fixed electroosmotic flow voltage, capture efficiency was evaluated for a unidirectional flow driven by a steady electric field for 20 min.

Capture Efficiency for with Switching Case: Sequentially Reversed Electroosmotic Flow Voltage Conditions To study the effect of switching on the capture efficiency, the flow was driven for 20 min, as in the case of flow without switching, with different electroosmotic flow voltages (500-900 V). However, in the case of switching the inlet reservoir was at a steady electroosmotic flow voltage and the outlet reservoir was at ground (0 V) for the initial 8 min. An initial time of 8 min was chosen to allow sufficient number of magnetic microbeads to fill the microchannel after being injected into the inlet reservoir. After this initial flow for 8 min, the voltages (500, 650, 750, 900 V) in the inlet and outlet reservoirs were switched (polarity changed) every 3 min. The time of 3 min allowed the uncaptured magnetic microbeads downstream of the magnet to return to the capture zone. Due to this process of sequential switching, the flow in the microchannel experienced a change in its direction at 8, 11, 14, and 17 min. The data (n=3) was plotted to study the variations in fluorescence intensity of captured beads, shown in FIG. 13B, with switching of electroosmotic flow voltage.

Example 5: Results of Experiments to Verify the Concept of Sequential Switching for Efficient Capture of a Microfluidic Device for Magnetic Microbeads Variation of Fluorescence Intensity with Steady EOF Voltages.

Figure 13A:
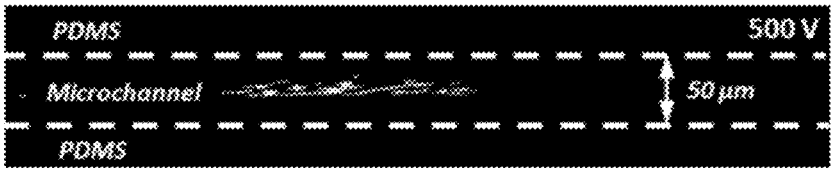
FIG. 13A. Fluorescent images taken after 20 min of flow of captured magnetic microbeads for flow driven at 500 V without switching the electroosmotic flow.
Figure 13B:
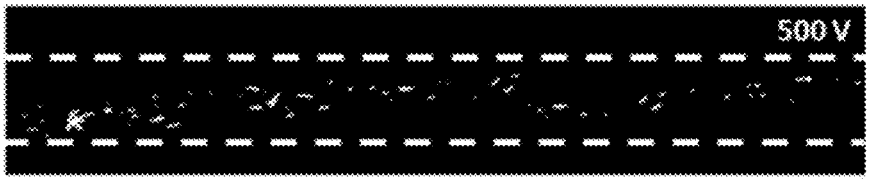
FIG. 13B. Fluorescent images taken after 20 min of flow of captured magnetic microbeads for flow driven at 500 V with switching the electroosmotic flow.

The superparamagnetic magnetic microbeads followed the fluid streamlines in the media (PBS, pH 7.4) until they reached the region of strong magnetic field near the NdFeB magnet, placed 5 mm above the microchannel. In this region, magnetic microbeads were pulled transversely in relation to the direction of the flow field, i.e., towards the NdFeB magnet. The magnetic microbeads were immobilized when the magnetic force exerted by the magnet was able to overcome the axial momentum of microbeads caused by the flow media. The fluorescent images of the magnetic microbeads immobilized by the magnet, as shown in FIG. 13A, were analyzed to quantify the capture efficiency of the device. The data (n=3) was plotted to study the variation of fluorescence intensity (pixel count) with voltage at the selected concentration (C). When the voltage was increased from 500 V to 900 V, the fluorescence intensity of the immobilized magnetic microbeads decreased by 79.0% (|[835.7]C2,900V−C2,500V|×100/[3988.3]C2,500V) for C. A significant correlation of the normalized fluorescence intensity with applied voltage (R2=0.99), showed that the CE decreased with increase in electroosmotic flow voltage.

Comparison of Capture Efficiency without Switching and with Switching.

Figure 14:
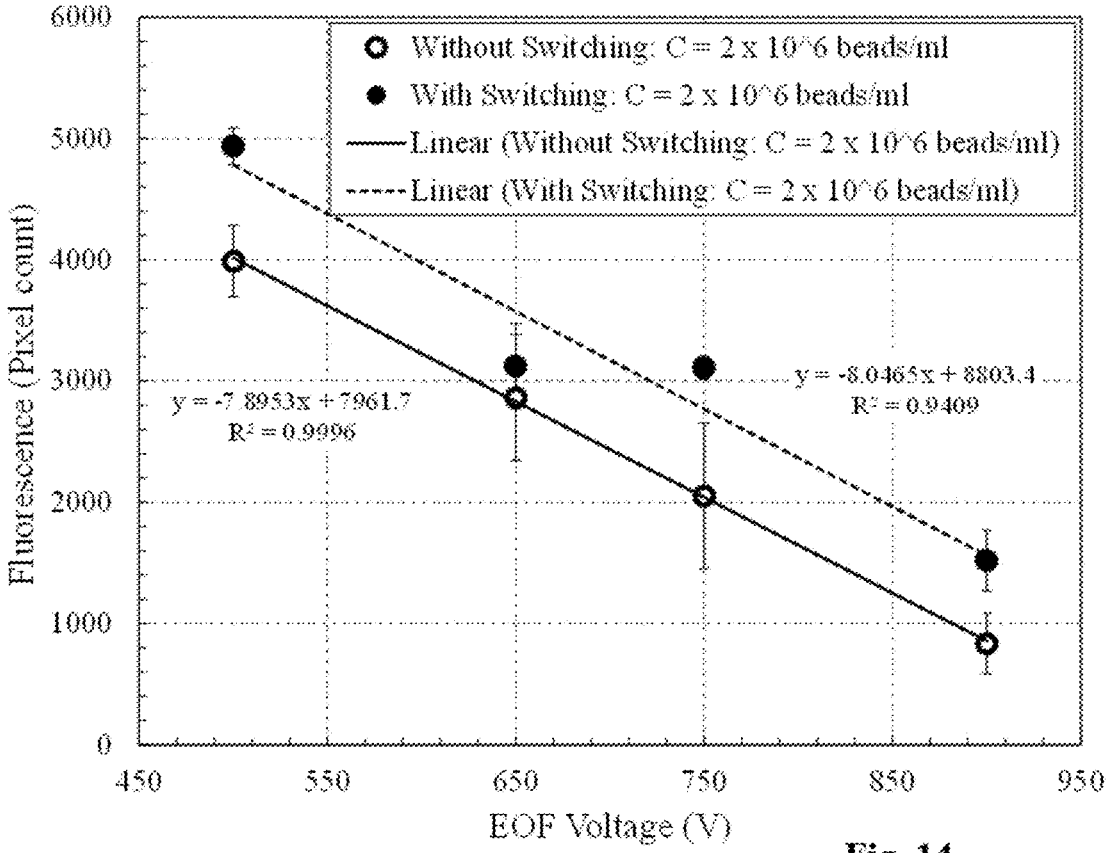
FIG. 14. Increase in fluorescence intensity of beads with switching the electroosmotic flow at different electroosmotic flow voltages.

For flow without switching case, the capture efficiency decreased with the increase in voltage. A similar trend was observed for flow with switching. However, for the same magnitude of applied voltage, switching the flow led to an increase in the capture efficiency. As can be inferred from FIG. 14, the reversal in the electroosmotic flow field, caused by switching, increased the capture efficiency of the system. The results indicate the influence of switching on increased number of magnetic microbeads immobilized in the microchannel and therefore, better capture efficiency. For comparison, the fluorescent images of the captured beads, without switching and with switching, are shown in FIG. 13 for an applied voltage of 500 V.

There was an average increase of 41.6% in capture efficiency with switching, with respect to the without switching case ([23.7500V+9.0650V+51.5750V+82.2900V]%/4). At higher voltages of 750-900 V, the relative increase in capture efficiency with switching was 1.71 times higher compared to the capture without switching. At lower voltages of 500-650 V, most of the magnetic microbeads were immobilized. This is because at lower electroosmotic flow voltages, i.e. lower flow rates, the magnetic force is able to overcome the magnetic microbeads' momentum. As a result, the scope for significant improvement in capture efficiency was limited to an increase of 21.7% at 500 V and 28.8% at 650 V. When the flow was driven at higher voltages without switching, many of the magnetic microbeads escaped. Switching the flow brought the escaped magnetic microbeads back into the region of higher magnetic field (capture zone), where the magnetic force was able to immobilize them. The increase in capture efficiency at 900 V was 82%.

Example 6: Discussion of Results of Experimental Data

The instant disclosure presents a simple and efficient technique of sequential switching which can be used in electroosmotic flow systems for capture of microfluidic devices for magnetic microbeads in a microfluidic channel. The electroosmotic flow was chosen in our system over pressure driven flow because it offered easier control over the changes in flow field, which is critical for the method of switching. For the steady electroosmotic flow (unidirectional flow of magnetic microbeads from inlet to outlet), the capture efficiency decreased with increase in electroosmotic flow voltage. However, the sequential switching of electroosmotic flow voltage caused the direction of flow to change periodically. This reversal in flow field caused the previously uncaptured magnetic microbeads to return to the capture zone and improved the capture efficiency of the device. The sequential switching of electroosmotic flow improved the capture efficiencies at both high (750, 900 V) and low (500, 600 V) EOF voltage ranges. These improvements were more significant at higher voltages of 750 V and 900 V where capture efficiency with switching was, on an average, ~70% more compared to flow without switching. The technique of sequential switching of electroosmotic flow has the potential to reduce the loss of reagents during magnetophoretic immunoassays in high throughput microfluidic devices.

Example 7: Materials and Methods of Experiments to Verify the Concept of Electromagnet for Efficient Capture of Magnetic Microbeads Fluorescent tagged mMBs were driven through the channel using EOF, immobilized using an external magnet, and characterized using inverted fluorescent microscopy. The images were analyzed to determine the total fluorescence of captured and uncaptured mMBs, allowing for the calculation of capture efficiency.

The microfluidic device was created through standard soft lithography technique with polydimethylsiloxane (PDMS) according to the procedure presented in Das et al. The resulting device consists of PDMS bonded to a glass slide to create a 50 mm channel with a cross section of 50 μm×50 μm with 6 mm diameter wells at each end of the channel.

Figure 15A:
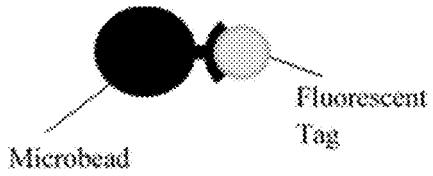
FIG. 15A. Schematics (not to scale) of fluorescently tagged beads.

The mMBs used in the experiments were 2.8 μm diameter Dynabead M280 Sheep anti-Rabbit IgG mMBs tagged with an Alexa Fluor 488 Rabbit anti-Mouse IgG fluorescent marker, as shown in FIG. 15A, following the procedure in Das et al. The microbeads were run through the system at concentrations of 2×106 and 4×106 beads/mL. The magnet used in the experiments was a ⅛"×⅛"×⅜" volume neodymium (NdFeB) magnet.

Figure 15B:
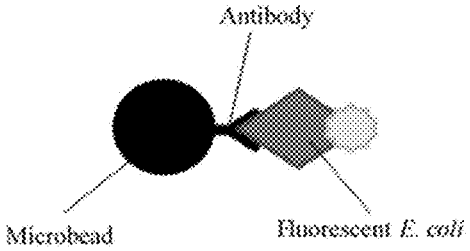
FIG. 15B is mMB-fluorescent bacteria complexes.

For the bacterial tests, the same mMBs were used in conjunction with a Virostat Rabbit polyclonal anti-*E. coli* binding antibody to bind to fluorescent *E. coli*, as shown in FIG. 15B. This created a bacteria-mMB complex that would allow the bacteria to be captured through magnetic separation; but prevent unpaired mMBs from producing incorrect results since only the bacteria is fluorescent. This also allowed the use of excess microbeads to ensure maximum bacteria capture without increasing the potential for inflated fluorescent results.

Experimental Method

The experimental preparation procedure outlined in Das et al. was followed for this study. The channel was treated with 1M NaOH solution for 10 minutes, washed with PBS buffer and, prior to each experiment, primed with a 1% Tween 20 in PBS buffer solution for 5 minutes to decrease the surface tension and prevent the mMBs from sticking to the channel walls while not captured.

Figure 15C:
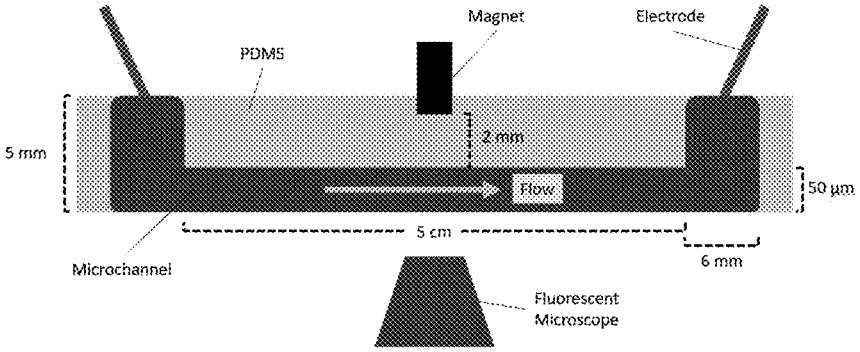
FIG. 15C is device setup used in experiments.

The mMB solution was injected into the inlet well and the chip was placed on an inverted fluorescent microscope using a xenon arc lamp with a filter for the Alexa Fluor 488 (excitation wavelength: 495 nm, emission wavelength: 519 nm). The magnet was put in place and two platinum electrodes were connected to a high voltage sequencer to drive the flow at voltages of 650 V and 750 V for 20 minutes, with the flow switching voltage profiles discussed in the Results. A diagram of the experimental setup is shown in FIG. 15C.

In order to better analyze the device, a capture zone calibration test was performed to determine the maximum capture zone for analysis. This test was performed by passing mMBs through the channel at the lowest flow rate and then immediately running buffer to clear uncaptured mMBs. The channel was then analyzed to determine the distance before and after the magnet where mMBs were captured. During experiments, mMBs before the capture zone are not considered since they did not enter the test, mMBs in the capture zone were determined to be captured, and mMBs after the capture zone and in the outlet well were determined to be missed.

Characterization

The gathered images were analyzed in MATLAB to determine the fluorescent intensity based on pixel count. The determination of capture zone allows for a unique characterization method that allows the calculation of a capture efficiency based on the ratio of the number of mMBs captured to the number of total mMBs run in the experiment. Statistical analysis was then performed using a t-test, with a resulting $p<0.05$ proving statistically significant.

The initial bacteria results were analyzed using the same process of image collection and processing. However, the raw fluorescent pixel counts were used to create a fluorescent calibration curve based on total fluorescence and bacteria concentration. The calibration curve was created at varying concentrations under the constant flow protocol at 650 V, with n=3 for each concentration.

Example 8: Results of Experiments to Verify the Concept of Electromagnet for Efficient Capture of Magnetic Microbeads Capture percentage was determined for mMB concentrations of 2×106 and 4×106 beads/mL, EOF voltages of 650 and 750 V, and under constant flow and switching flow protocols. Fluorescent images were taken of samples with known concentrations to determine a calibration curve based on fluorescent intensity.

Fluorescence Calibration of mMBs

Figure 16A:
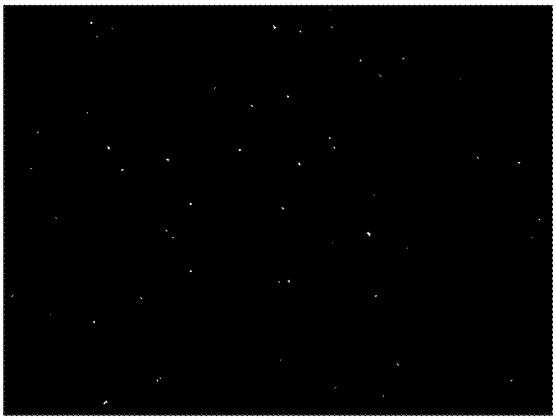
FIG. 16A. Image of fluorescence from sample with concentration of 1×106 beads/mL.
Figure 16B:
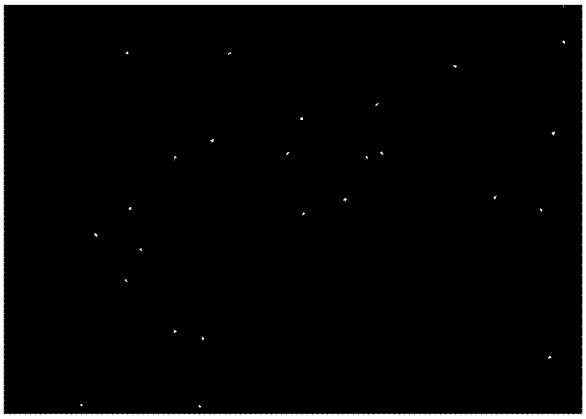
FIG. 16B is image of fluorescence from sample with concentration of 2×106 beads/mL.
Figure 16C:
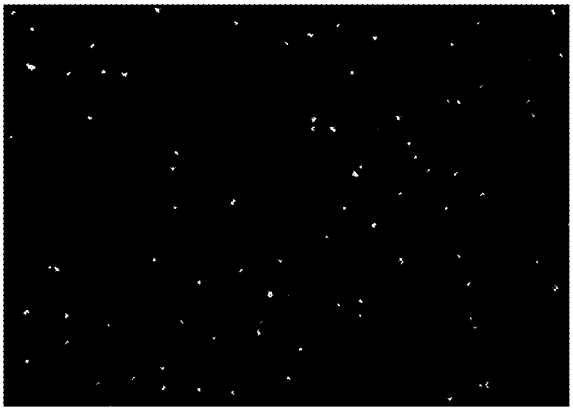
FIG. 16C is image of fluorescence from sample with concentration of 1×107 beads/mL.
Figure 16D:
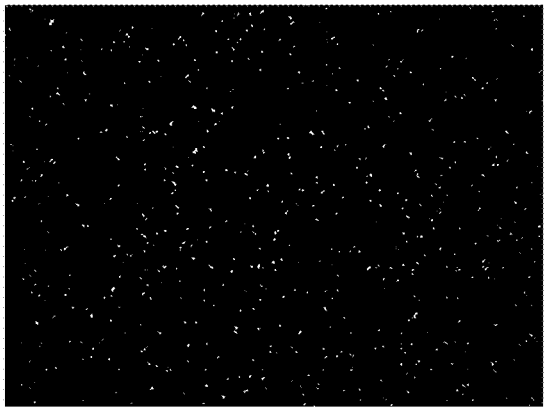
FIG. 16D is image of fluorescence from sample with concentration of 2×107 beads/mL.
Figure 16E:
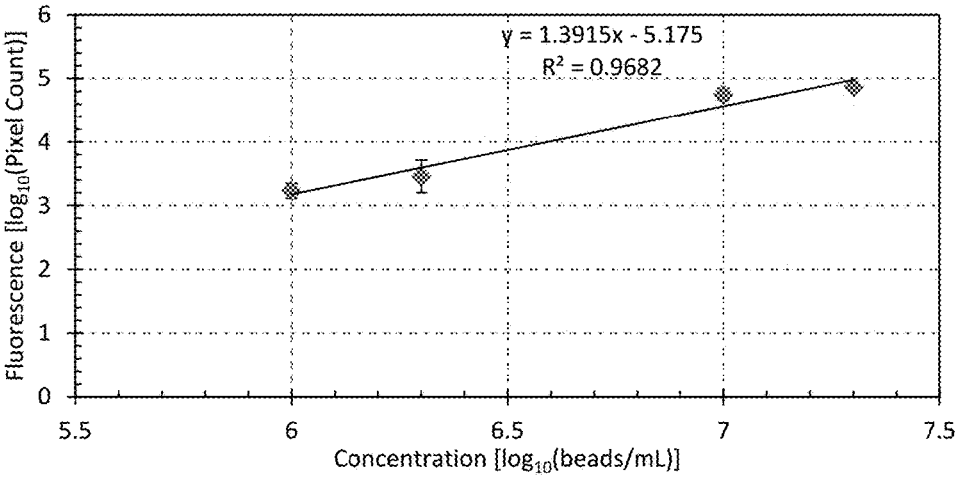
FIG. 16E is calibration curve of fluorescence as a function of mMB concentration.

Samples of known concentration of fluorescently tagged mMBs were put on a microscope slide and imaged using fluorescent microscopy, with images for various concentrations shown in FIGS. 16A, 16B, 16C, and 16D. These images were analyzed to determine the fluorescent intensity in terms of pixel count associated with each known concentration. These results are shown as a function of concentration in FIG. 16E in the form of a calibration curve. This curve can be used to determine effective concentration of beads captured given unknown inlet samples.

Constant Flow and Switching Flow

Constant and flow switching protocols were compared in an effort to assess the increase the capture efficiency of mMBs in the device. The constant flow protocol uses a fixed potential difference along the channel to drive a constant flow from inlet to outlet over the entire 20 minute test period with the flow rate calculated according to the Helmholtz-Smoluchowski Equation, as shown in Eq. (14)

$$U_{ep} = -\frac{E_z \varepsilon_r \varepsilon_0 \zeta_p}{\mu} \tag{14}$$

where $U_{ep}$ is the velocity (cm/s), $E_z$ is the applied electric field (V/cm), $\varepsilon_r$ is the dielectric constant of the medium, $\varepsilon_o$ is the vacuum permittivity (F/m), $\zeta_p$ is the zeta potential (V), and $\mu$ is the dynamic viscosity (Pa·s). For the 650 V case, $E_z$ is 130 V/cm, $\varepsilon_r$ is 80.4, $\varepsilon_o$ is $8.55\times10^{-12}$ F/m, $\zeta_p$ is −95.6 mV, and $\mu$ is $8.6\times10^{-4}$ Pa·s. The fluid velocity at this voltage was determined to be 0.099 cm/s, which equates to a volumetric flow rate of 0.15 μL/min. The switching protocol aims to increase capture by alternating flow direction by changing the voltage at the inlet and outlet to increase mMB residence time in the capture zone. The switching protocol runs for 8 minutes forward followed by two periods of alternating 3 minutes backward then 3 minutes forward, for a 20 minute total testing time. With a 5 cm long channel and EOF flow rates of 0.099 cm/s and 0.115 cm/s for the 650 and 750 V cases, respectively, a 3 minute run time would allow for about 3.5 and 4 full channel length (5 cm) clearances at the two voltages. This allowance for multiple full flows through the channel helps ensure a high quantity of mMBs are available to be analyzed.

Capture Efficiency of Constant Flow and Switching Flow Protocols

Figure 17A:
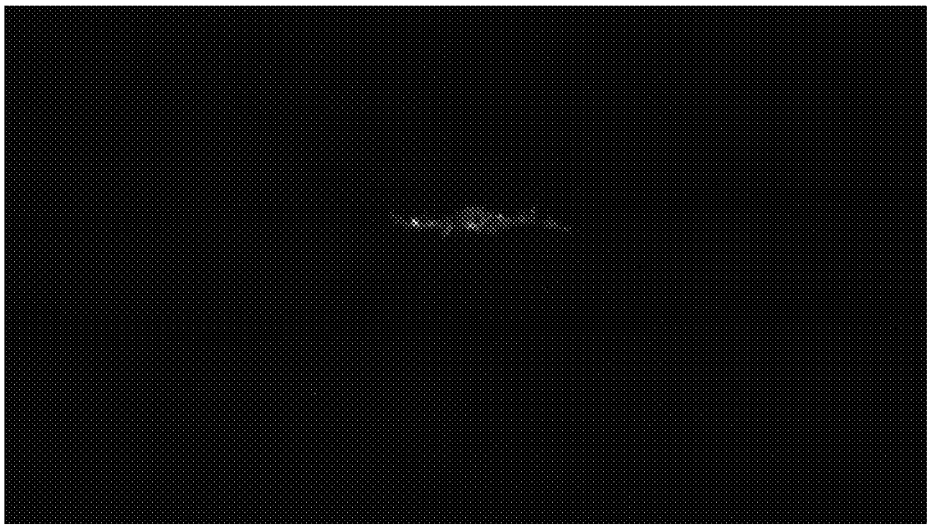
FIG. 17A. Captured mMBs from 2×106 beads/mL sample at 750 volts using constant protocol.
Figure 17B:
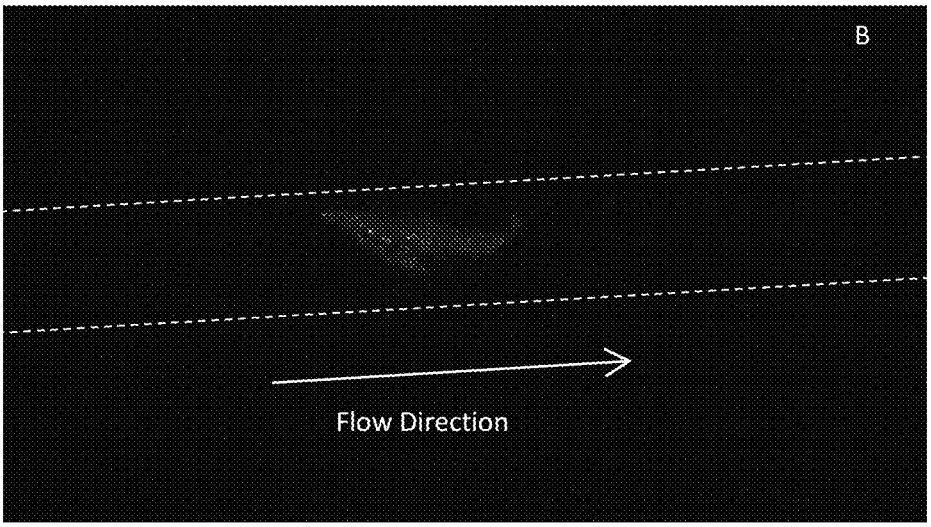
FIG. 17B captured mMBs from 4×106 beads/mL sample at 650 volts using switching protocol.
Figure 17C:
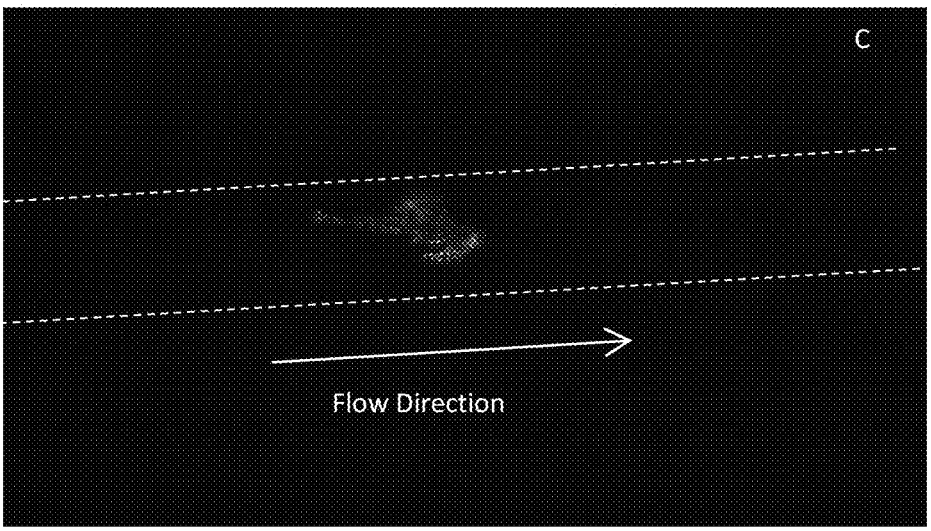
FIG. 17C captured mMBs from 4×106 beads/mL sample at 750 volts using switching protocol.

Fluorescent tagged mMBs in solutions of $2\times10^6$ and $4\times10^6$ beads/mL were run through the device using both switching and constant flow protocols at voltages of 650 and 750 V, with images were taken along the channel. Sample images of captured mMBs at $2\times10^6$ beads/mL, 750 volts, and constant flow; $4\times10^6$ beads/mL, 650 volts, and switching flow; and $4\times10^6$ beads/mL, 750 volts and switching flow are shown in FIGS. 17A, 17B, and 17C, respectively. The images were then analyzed, with mMBs imaged within the capture zone counted as captured and mMBs located after the capture zone counted as uncaptured. Those mMBs located before the capture zone were not considered since they did not ever enter the test scenario.

The capture efficiency ($\eta_c$) of the device was determined using Eq. (15), with the relative percent difference between the constant and switching flow protocols calculated using Eq. (16).

$$\eta_c = \frac{\text{pixel count captured}}{\text{pixel count captured} + \text{pixel count uncaptured}} \tag{15}$$

$$\text{Relative \% Difference} = \frac{\eta_{c_switch} - \eta_{c_constant}}{\eta_{c_{constant}}} \tag{16}$$

Figure 18:
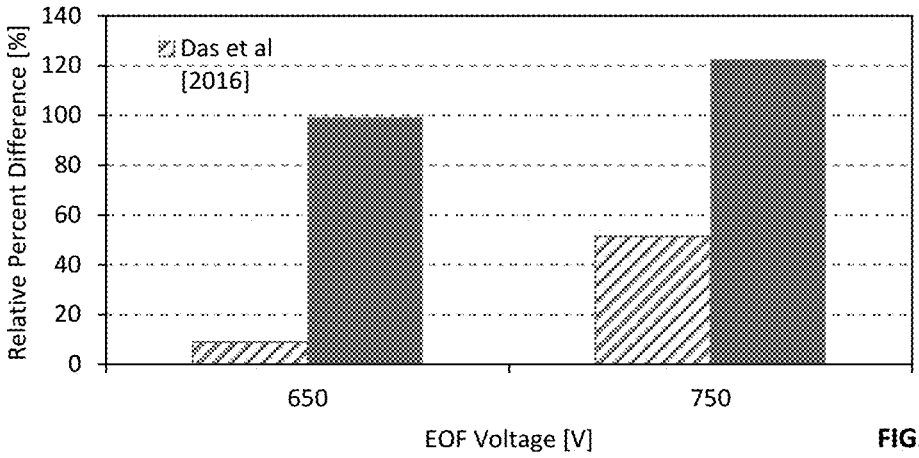
FIG. 18. Comparison of relative percent difference between switching and constant flow protocols for 2×106 beads/mL samples for this experiment and Das et al.

The relative percent difference between the switching and constant flow obtained from this experiment was compared to the results of the Das et al. experiment, as shown in FIG. 18. The present experiment shows a much higher $\eta_c$, with a relative percent difference increase of 99% and 122% compared to 9% and 52% between switching flow and constant flow for the 650 V and 750 V, respectively. This improvement is due to the analysis of beads that are run through the system but remained uncaptured. In the Das et al. experiment, $\eta_c$ is calculated where only the captured beads were accounted for. Moreover, the total number of mMBs passing through the device is higher for the constant flow than the switching flow, causing an increased constant flow fluorescence. This resulted in a smaller difference between the two protocols. Since the present experiment accounts for the number of uncaptured beads that are run through the system, an accurate comparison can be made between the switching and constant flows.

Figure 19A:
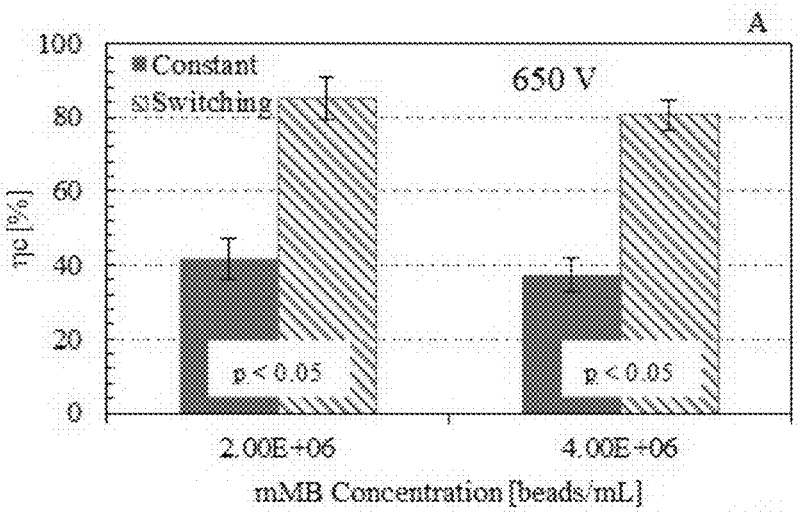
FIG. 19A. Capture efficiency of mMBs under switching and constant protocols at 650 V.
Figure 19B:
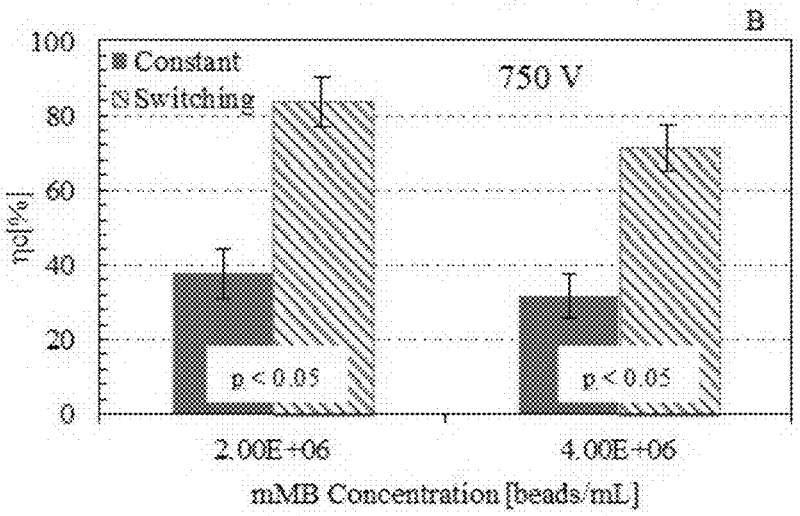
FIG. 19B Capture efficiency of mMBs under switching and constant protocols at 750 V.

The m for the 650 V and 750 V scenarios are shown in FIGS. 19A and 19B, respectively. For all concentrations and voltages, the $\eta_c$ of mMBs was significantly higher for the switching flow protocol (71% to 85%) versus the constant flow protocol (31% to 42%), with a relative percentage difference of around 2 times $\eta_c$ with $p<0.05$ for all cases. This significant increase in $\eta_c$ shows the effectiveness of the flow switching in returning the initially uncaptured mMBs to the capture zone while those mMBs remain uncaptured in the constant flow case.

Bacteria Calibration Curve Under Constant Flow Protocol

Figure 20:
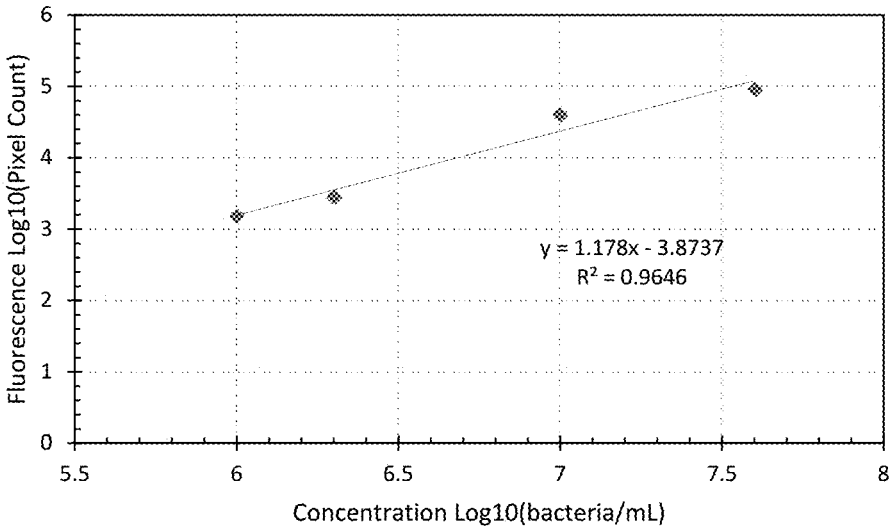
FIG. 20. Calibration curve of bacteria-mMB complex under constant flow protocol at 650 V.

Initial bacteria testing provided a calibration curve of fluorescent intensity as a function of concentration under the constant flow protocol at 650 V. This curve is linear on a log-log plot with a $R^2$ value of 0.96, as shown in FIG. 20. There is an increase in total fluorescent pixel count as bacteria concentration in the sample increases, with $p<0.05$ for each comparison of fluorescent intensity between neighboring concentrations.

Example 9: Discussion of Results of Experiments to Verify the Concept of Electromagnet for Efficient Capture of Magnetic Microbeads While the total fluorescence measured in the Das et al. study can help determine the sensitivity of the device and fluorescent difference at various concentrations, it has a shortcoming in that it cannot accurately compare the ηc of mMBs for different scenarios. This study uses a unique approach to determine the improved ηc of the device by comparing the number of mMBs that are captured to the total number of mMBs run through the device.

Capture Zone

The determination of the capture zone is an important aspect for determining ηc in this study. Bead capture is determined by the balance between the horizontal momentum and drag forces and vertical magnetic forces acting on the mMBs. When the net horizontal force is much greater than the magnetic force, the mMB escapes while the mMB is captured if the magnetic force is much greater than the net horizontal force. Since the magnetic force is constant for all situations, the maximum bead capture will occur at the lowest fluid velocity. Therefore, the minimum EOF voltage of 650 V is used in the determination of capture zone since it produces the lowest fluid velocity.

Capture Efficiency Under Constant and Switching Flows

The ηc associated with the switching protocol was about 2 times larger than the ηc under the constant flow protocol for all conditions. Under constant flow, the mMBs only make one pass by the magnet, so any mMB that avoids initial capture are lost. However, under the flow switching protocol, mMBs that are not initially captured have a chance to return to the area of higher magnetic force due to the switching of the horizontal forces and, therefore, have an increased opportunity to be captured. This increased residence time in the capture zone produces significantly higher capture efficiencies associated with the switching protocol. The increase of ηc from approximately 42% under constant flow to around 85% under switching flow is critical in minimizing the error in the future application of isolating pathogens using the device.

Bacteria Calibration Curve Under Constant Flow

The initial log-log calibration curve shows a linear comparison, highlighting the consistency of bacteria capture within the device. Additionally, the statistically significant p-values when comparing neighboring concentrations demonstrates the feasibility of the device to accurately and reliably differentiate between concentrations in unknown samples.

Various modifications of the present invention, in addition to those shown and described herein, will be apparent to those skilled in the art of the above description. Such modifications are also intended to fall within the scope of the appended claims.

It is appreciated that all reagents are obtainable from commercial sources known in the art unless otherwise specified.

Patents, publications, and applications mentioned in the specification are indicative of the levels of those skilled in the art to which the invention pertains. These patents, publications, and applications are incorporated herein by reference to the same extent as if each individual patent, publication, or application was specifically and individually incorporated herein by reference.

The foregoing description is illustrative of particular aspects of the invention, but is not meant to be a limitation upon the practice thereof.

What is claimed is:

1. A method of enhancing the capture efficiency of microfluidic devices for a target reagent in a fluid medium, the method comprising:

a) providing a microfluidic device comprising at least one microfluidic channel, the at least one microfluidic channel comprising a first end and a second end;

b) generating a first electroosmotic force sufficient to cause the fluid medium comprising the target reagent to flow within the at least one microfluidic channel in a first flow direction and sustaining the first electroosmotic force at least until a steady state plug profile of the fluid medium is attained;

c) generating a second electroosmotic force sufficient to cause the fluid medium comprising the target reagent to flow within the at least one microfluidic channel in a second direction and sustaining the second electroosmotic force at least until a steady state plug profile of the fluid medium is attained, wherein the second direction is the reverse of the first direction;

d) applying a magnetic field externally to the at least one microfluidic channel, thereby generating a magnetic force for capturing the target reagent in the at least one microfluidic channel with the magnetic field; and e) reversing the magnetic field applied in step d) externally to the at least one microfluidic channel, thereby generating a transient variation in magnetic force for capturing the target reagent in the at least one microfluidic channel with the magnetic field.

2. The method of claim 1, wherein the generating the second electroosmotic force comprises reversing the first electroosmotic force.

3. The method of claim 1, further comprising the step of removing the first electroosmotic force before generating the second electroosmotic force.

4. The method of claim 1, further comprising generating a third electroosmotic force sufficient to cause the fluid medium comprising the target reagent to flow within the at least one microfluidic channel in the first flow direction and sustaining the second electroosmotic force at least until a steady state plug profile of the fluid medium is attained.

5. The method of claim 1, wherein the first flow direction is towards the second end of the microfluidic channel.

6. The method of claim 1, wherein the second flow direction is towards the first end of the microfluidic channel.

7. The method of claim 1, wherein generating the first electroosmotic force comprises applying a first voltage differential between the first end and the second end of the at least one microfluidic channel sufficient to cause a reagent to flow within the at least one microfluidic channel in a first flow direction.

8. The method of claim 7, wherein generating the second electroosmotic force comprises applying a second voltage differential between the first end and the second end of the at least one microfluidic channel sufficient to cause the reagent to flow within the at least one microfluidic channel in a second direction, wherein the second direction is the reverse of the first direction.

9. The method of claim 8, wherein applying a second voltage differential comprises reversing the first voltage differential.

10. The method of claim 8, wherein the method further comprises removing the first voltage differential before applying the second voltage differential.

11. The method of claim 7, wherein the step of applying the first voltage differential comprises applying a first voltage to the inlet of the first end of the at least one microfluidic channel and a second voltage, lower than the first voltage, to the second end of the at least one microfluidic channel.

12. The method of claim 8, wherein the step of applying the first voltage differential comprises applying a first voltage to the outlet of the first channel and a second voltage lower than the first voltage, to the inlet of the first channel.

13. The method of claim 1, wherein the magnetic field is applied in dynamic or transient manner through an external electromagnet.

14. The method of claim 13, wherein a dynamically changing the voltage/electric field is applied to the electromagnet allowing transient variation of the magnetic field.

15. A method of increasing the efficiency of a microfluidic device, the method comprising:

a) providing a microfluidic device comprising: i) at least one microfluidic channel, the at least one microfluidic channel comprising a first end and a second end;

b) generating an electroosmotic flow sufficient to cause a fluid medium comprising a target reagent to flow within the at least one microfluidic channel in a first flow direction and sustaining the electroosmotic flow in the first flow direction at least until a steady state plug profile of the fluid medium is attained;

c) reversing the electroosmotic flow, wherein the reversal of the electroosmotic flow is sufficient to reverse the flow direction of the fluid medium comprising the target reagent within the at least one microfluidic channel direction and sustaining the electroosmotic flow in the second flow direction at least until a steady state plug profile of the fluid medium is attained; and d) externally applying a magnetic field to the at least one microfluidic channel, thereby generating a magnetic force for capturing the target reagent in the at least one microfluidic channel with the externally applied magnetic field.

16. The method of claim 15, wherein generating an electroosmotic flow comprises applying a first voltage differential between the first end and the second end of the at least one microfluidic channel.

17. The method of claim 16, wherein reversing the electroosmotic flow comprises applying a second voltage differential between the first end and the second end of the at least one microfluidic channel.

18. The method of claim 17, wherein applying a second voltage differential comprises reversing the first voltage differential.

19. The method of claim 17, wherein the method further comprises removing the first voltage differential before applying the second voltage differential.

20. The method of claim 17, wherein the step of applying the second voltage differential comprises applying a first voltage to the second end of the first channel and a second voltage lower than the first voltage, to the first end of the first channel.

21. The method of claim 15, wherein the step of applying the first voltage differential comprises applying a first voltage to the first end of the at least one microfluidic channel and a second voltage, lower than the first voltage, to the second end of the at least one microfluidic channel.

22. The method of claim 15, wherein the electroosmotic flow is reversed at least twice.

* * * * *